US007513583B2

(12) United States Patent
Niimi

(10) Patent No.: US 7,513,583 B2
(45) Date of Patent: Apr. 7, 2009

(54) PRINTING APPARATUS

(75) Inventor: Akiko Niimi, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 288 days.

(21) Appl. No.: 11/706,339

(22) Filed: Feb. 15, 2007

(65) Prior Publication Data

US 2007/0195119 A1 Aug. 23, 2007

(30) Foreign Application Priority Data

Feb. 21, 2006 (JP) ..... 2006-044106

(51) Int. Cl.
*B41J 3/00* (2006.01)
*B41J 29/38* (2006.01)

(52) U.S. Cl. ..... 347/2; 347/16

(58) Field of Classification Search ..... 347/2, 347/16

See application file for complete search history.

(56) References Cited

U.S. PATENT DOCUMENTS 6,883,911 B2 4/2005 Niimi et al.

FOREIGN PATENT DOCUMENTS

| | | |
|---|---|---|
| JP | A 2004-291430 | 10/2004 |
| JP | A 2004-291461 | 10/2004 |
| JP | A 2005-246620 | 9/2005 |

*Primary Examiner*—Julian D Huffman
(74) *Attorney, Agent, or Firm*—Oliff & Berridge, PLC

(57) ABSTRACT

A printing apparatus for fabric, comprising a retainer unit having a retainer surface on which a piece of fabric is removably installed, an ink ejecting unit which ejects ink onto a surface of the fabric retained by the retainer unit according to image data transmitted from an external device, an image data receiving system which receives the image data transmitted from the external device, and a print controlling system which controls executing one of a normal printing operation wherein the image data received by the image data receiving system is printed on the surface of the piece of fabric retained by the retainer unit and a positioning information printing operation wherein positioning information to be used for arranging the piece of fabric in position with respect to the retainer surface is printed on the retainer surface, is provided.

9 Claims, 19 Drawing Sheets

PRINTING APPARATUS

CROSS REFERENCE TO RELATED APPLICATIONS

This application claims priority from Japanese Patent Application No. 2006-044106, filed on Feb. 21, 2006, the entire subject matter of which is incorporated herein by reference.

BACKGROUND

1. Technical Field

Aspects of the present invention relate to a printing apparatus, and more specifically to a printing apparatus with a supporting base having a supporting surface for holding fabric as a printing medium being installed in the printing apparatus.

2. Related Art

Conventionally, a printing apparatus for fabric capable of forming an image by ejecting ink onto fabric as a printing medium, wherein the fabric is held by a platen to support the fabric, has been suggested. Such a printing apparatus is disclosed in Japanese Patent Provisional Publication No. 2004-291430. In this printing apparatus, the platen has a flat surface to support the fabric. Further, the supporting surface is provided with a cotton cloth which has a greater friction coefficient thereon so that the fabric can be stabled on the platen. In the printing apparatus, generally a size of the fabric is greater than the supporting surface, and an operator sets the fabric on the platen so that the supporting surface is covered with the fabric.

Meanwhile, a positioning program for printing, which facilitates positioning of a recording medium without using an image input device such as a scanner when an image is printed on a predetermined position of the recording medium, is known. An example of such a positioning program is disclosed in Japanese Patent Provisional Publication No. 2005-246620, for example. In this positioning program, grid lines to indicate coordinates are printed on a supplemental sheet such as an OHP sheet and paper so that the coordinates of the predetermined position on the recording medium can be specified as the supplemental sheet is overlaid on the recording medium upon printing the image on the recording medium.

SUMMARY OF THE INVENTION

Aspects of the present invention are advantageous in that a printing apparatus capable of positioning the fabric as a recording medium in an easy manner when the fabric is set on a supporting surface of the printing apparatus is provided.

BRIEF DESCRIPTION OF THE ACCOMPANYING DRAWINGS

Figure 17:
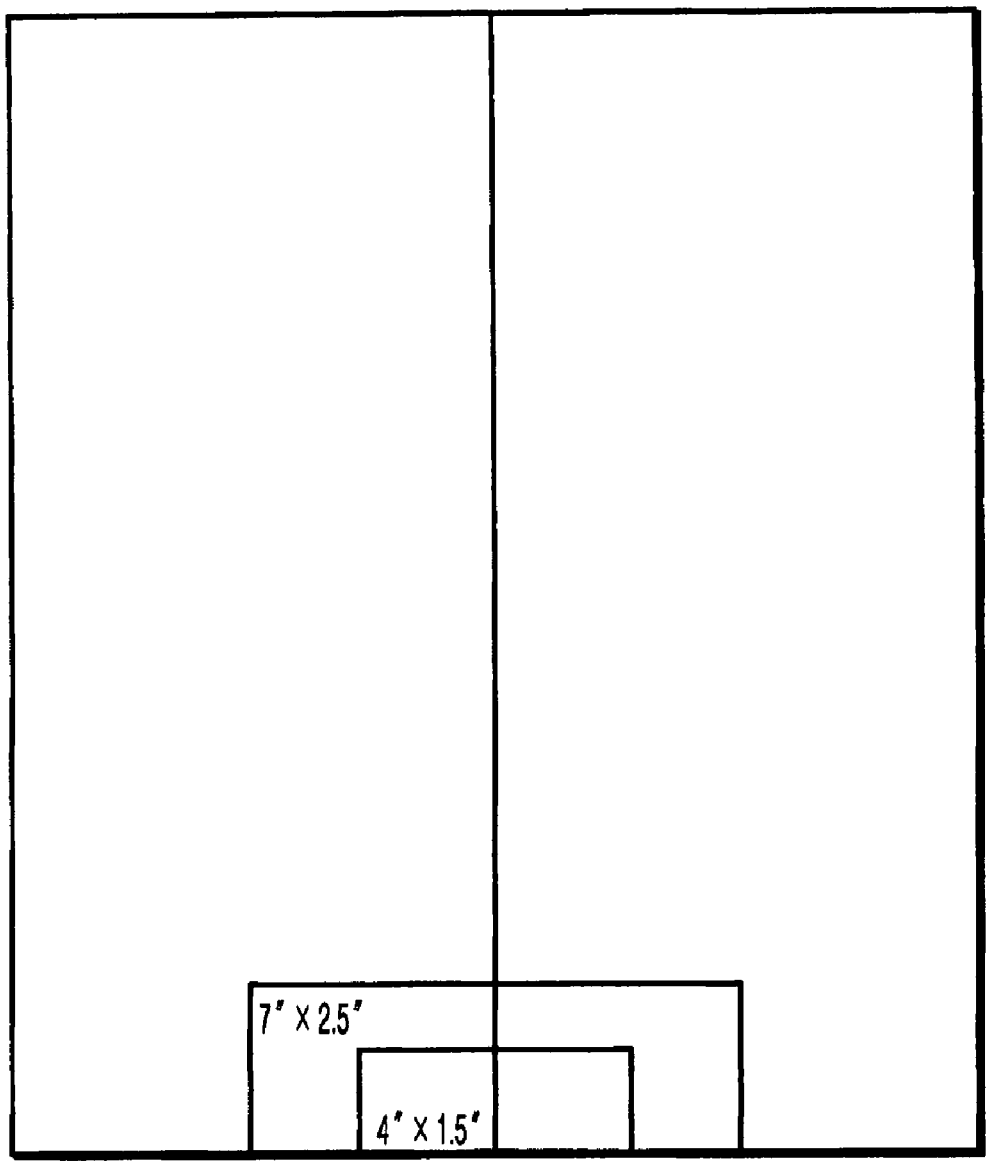
Figure 18:
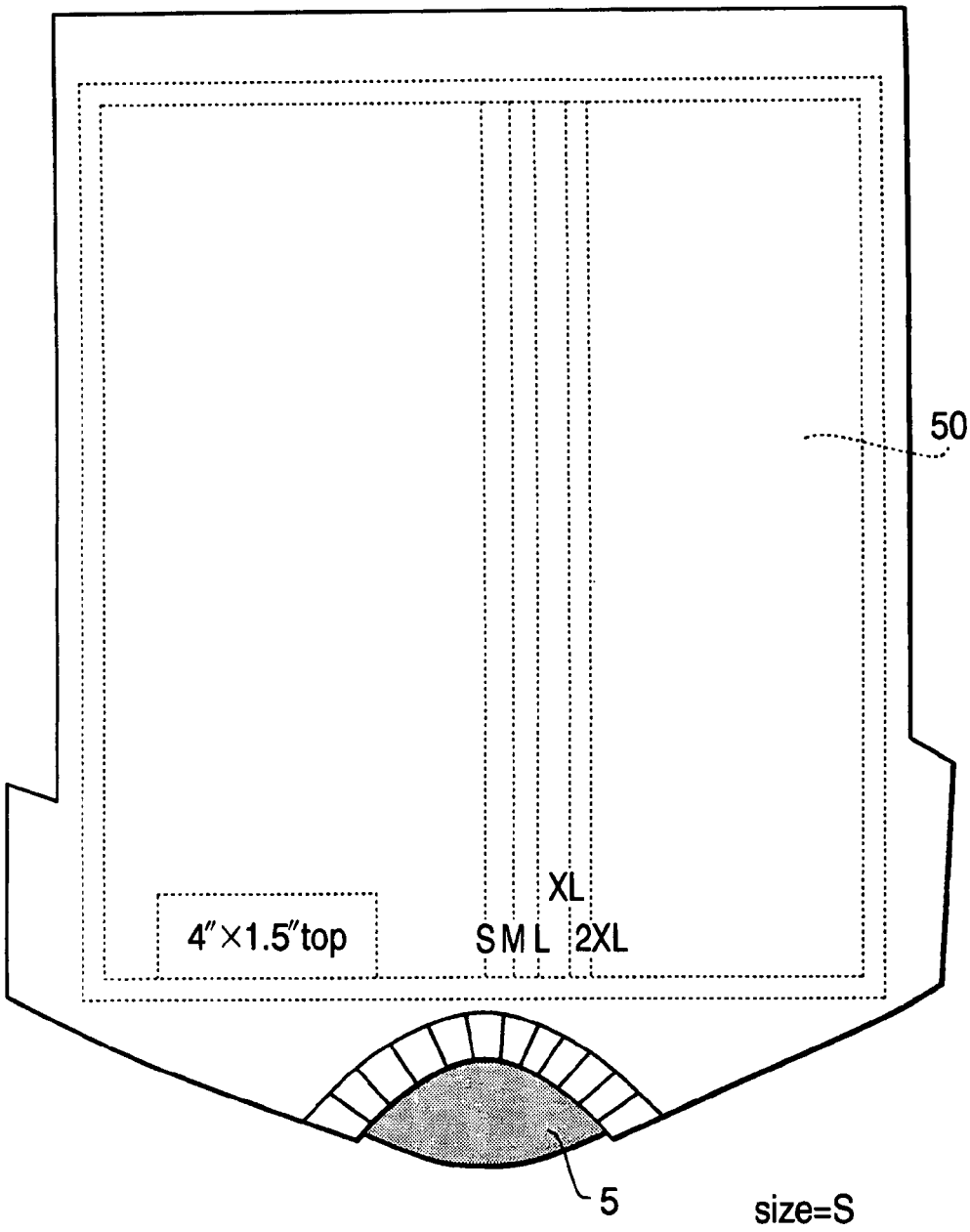

FIG. 17 is an illustrative plan view of the sheet member 50 with a third positioning index printed thereon according to the first embodiment of the invention FIG. 18 is an illustrative plane view of a T-shirt in size S being positioned on the platen 5 with the sheet member 50 having the second positioning index printed thereon according to the first embodiment of the invention.

Figure 19:
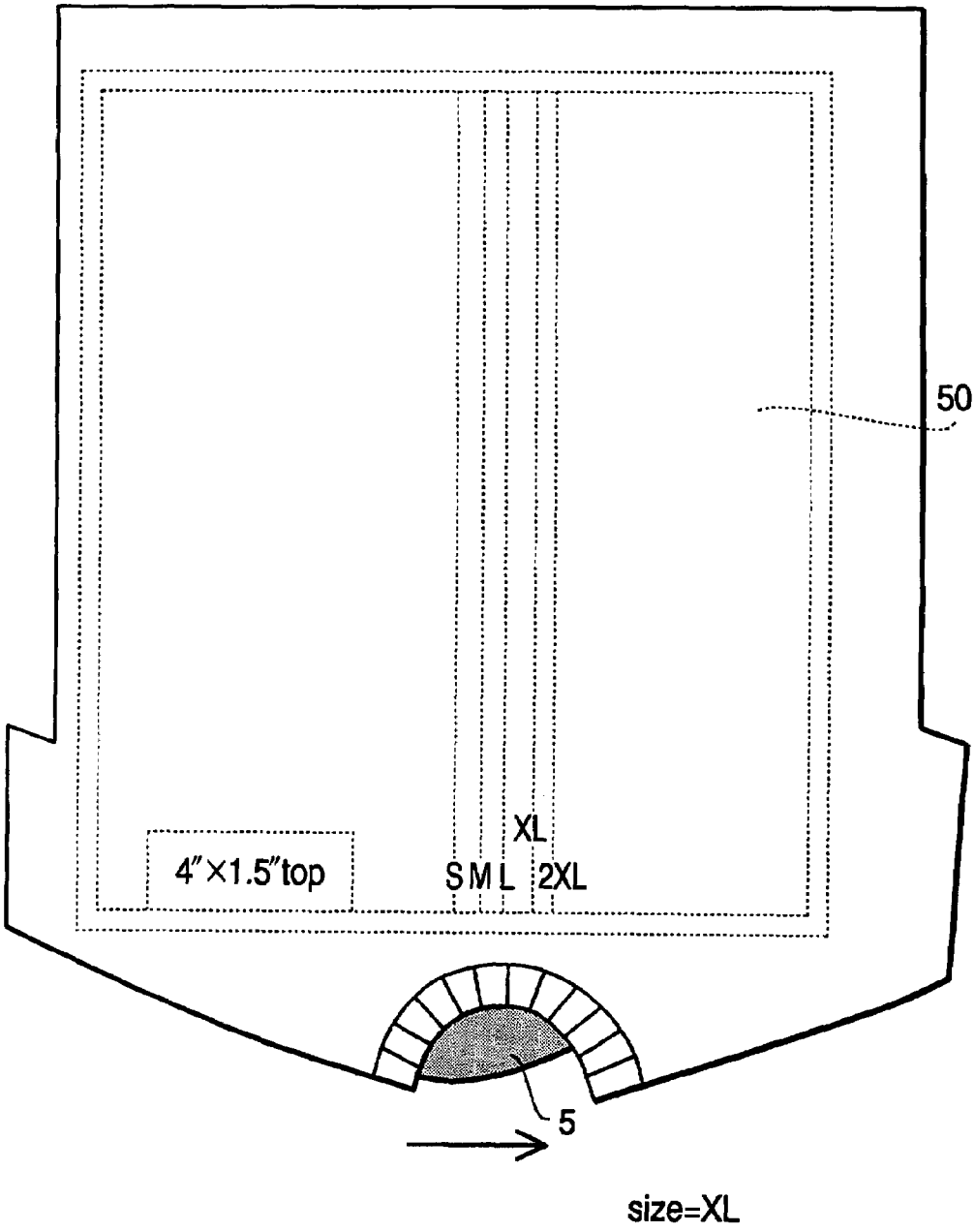

FIG. 19 is an illustrative plane view of a T-shirt in size XL being positioned on the platen 5 with the sheet member 50 having the second positioning index printed thereon according to the first embodiment of the invention.

Figure 20:
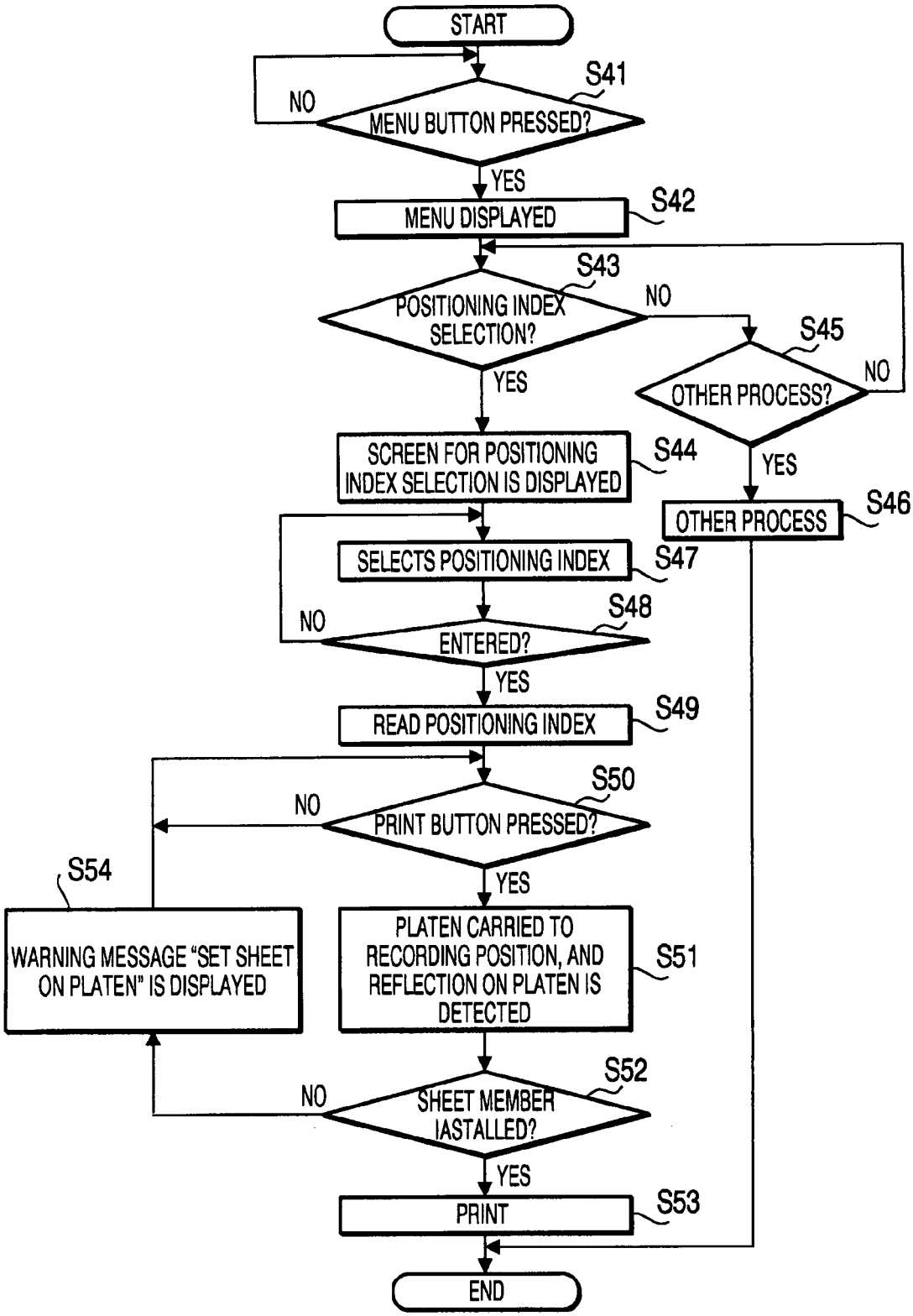

FIG. 20 is a flowchart of a printing process of the positioning index in a fabric printer 2 according to a second embodiment of the invention.

Figure 21:
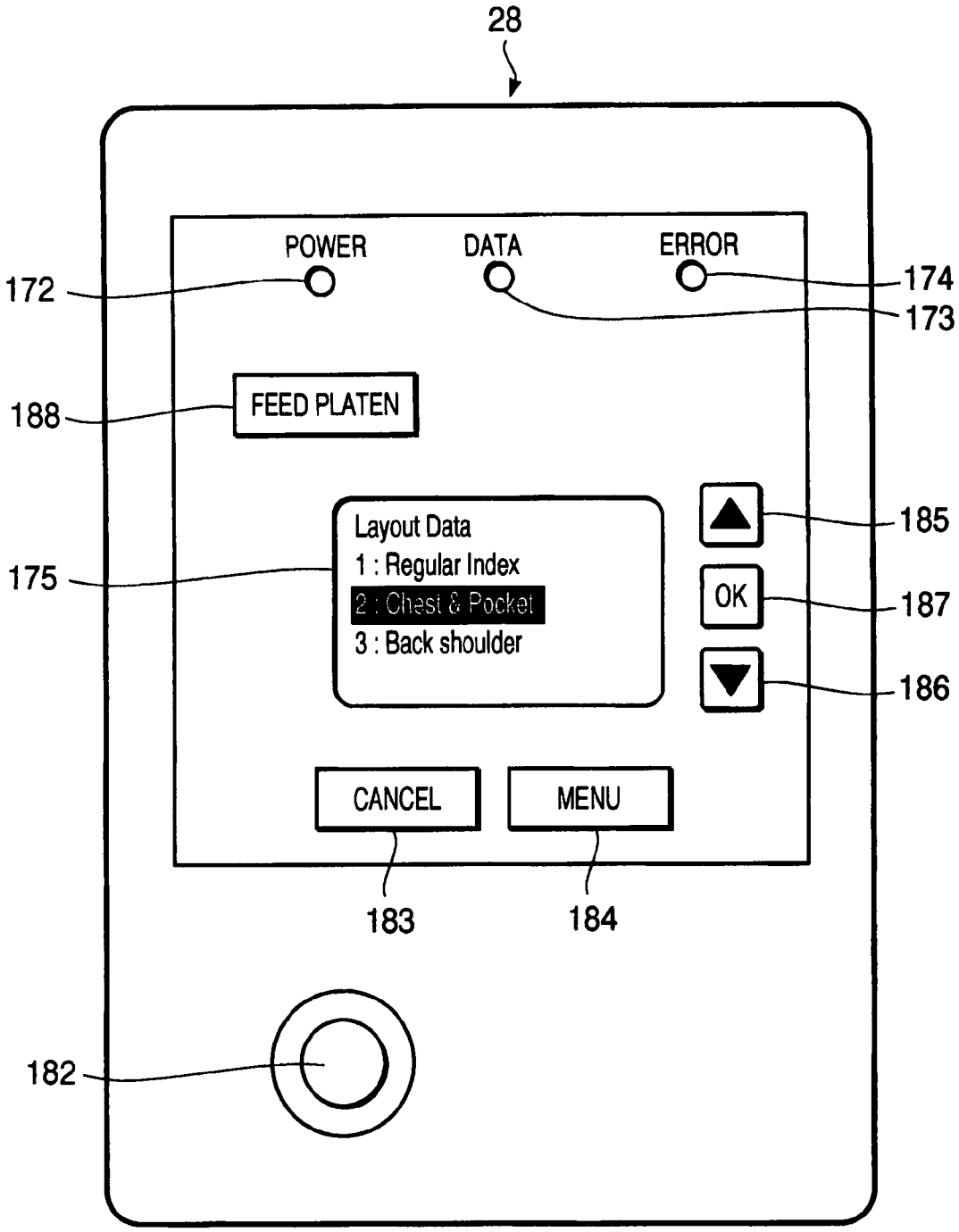

FIG. 21 illustrates a setting screen for selecting the positioning index shown on the operation panel 28 of the fabric printer 1 according to the second embodiment of the invention.

DETAILED DESCRIPTION

General Overview

The following describes general aspects of the invention that may or may not be included in various examples and modifications. It should be noted that various connections are set forth between elements in the following description. It should be noted that these connections in general and, unless specified otherwise, may be direct or indirect and that this specification is not intended to be limiting in this respect.

According to some aspects of the invention, there is provided a printing apparatus for fabric, comprising a retainer unit having a retainer surface on which a piece of fabric is removably installed, an ink ejecting unit which ejects ink onto a surface of the fabric retained by the retainer unit according to image data transmitted from an external device, an image data receiving system which receives the image data transmitted from the external device, and a print controlling system which controls executing one of a normal printing operation wherein the image data received by the image data receiving system is printed on the surface of the piece of fabric retained by the retainer unit and a positioning information printing operation wherein positioning information to be used for arranging the piece of fabric in position with respect to the retainer surface is printed on the retainer surface.

In the printing apparatus configured as above, the print controlling system can control the positioning information printing operation to print the positioning information, which is used for arranging the piece of fabric in position, on the retainer surface so that the piece of the fabric can be easily arranged in position on the retainer surface. A user of the printing apparatus can fix a position of the piece of the fabric on the retainer surface by referring to the positioning information printed on the retainer surface. Thereafter, the print controlling system controls the normal printing operation wherein the ink is ejected from the ink ejecting unit onto the piece of the fabric according to the image data received by the image data receiving system. Thus, the piece of the fabric can easily be arranged in position on the retainer surface of the retainer unit.

Optionally, the printing apparatus may further comprise a positioning information storing system, wherein the positioning information is stored.

According to the above configuration, the positioning information can be stored in the positioning information storing system so that the positioning information obtained from the positioning information storing system can be printed on the retainer surface. Thus, positioning information preferable to a type of the piece of fabric can be stored in the positioning information storing system in advance.

Optionally, the positioning information stored in the positioning information storing system may be used to guide the piece of fabric in position on the retainer surface, and the positioning information storing system may store a plurality of patterns of positioning information, one of which is selectively used to guide the piece of fabric in position according to a type of the piece of fabric.

According to the above configuration, a preferable pattern among the plurality of patterns of positioning information can be selected according to a type of the piece of the fabric to be printed on the retainer surface.

Optionally, the positioning information may include a plurality of lines each of which indicates a position of the piece of fabric to be arranged according to a size of the piece of fabric.

According to the above configuration, a plurality of different sizes of the piece of fabric can be arranged on the retainer surface by using the plurality of lines included in one pattern of positioning information.

Optionally, an L* value of a color of the ink to be used for printing the positioning information in the positioning information printing operation may be at most 70.

According to the above configuration, visibility of the positioning information printed on the retainer surface can be improved.

Optionally, the print controlling system may control printing the positioning information specified by a user via a computer being connected with the printing apparatus by ejecting the ink from an ejecting portion of the ink ejecting unit onto the retainer surface in the positioning information printing operation.

According to the above configuration, an additional operation in the printing apparatus to specify the positioning information is unnecessary.

Optionally, the retainer unit may be configured as such at least one of the retainer unit itself is exchangeable with respect to the printing apparatus and the retainer surface is exchangeable with respect to the retainer unit.

Optionally, the printing apparatus may further comprise a detecting system which detects presence and absence of the retainer surface of the retainer unit.

According to the above configuration, the user can be warned and the positioning information printing operation can be ceased when the detecting system detects absence of the retainer surface in the printing apparatus.

DETAILED DESCRIPTION

Figure 1:
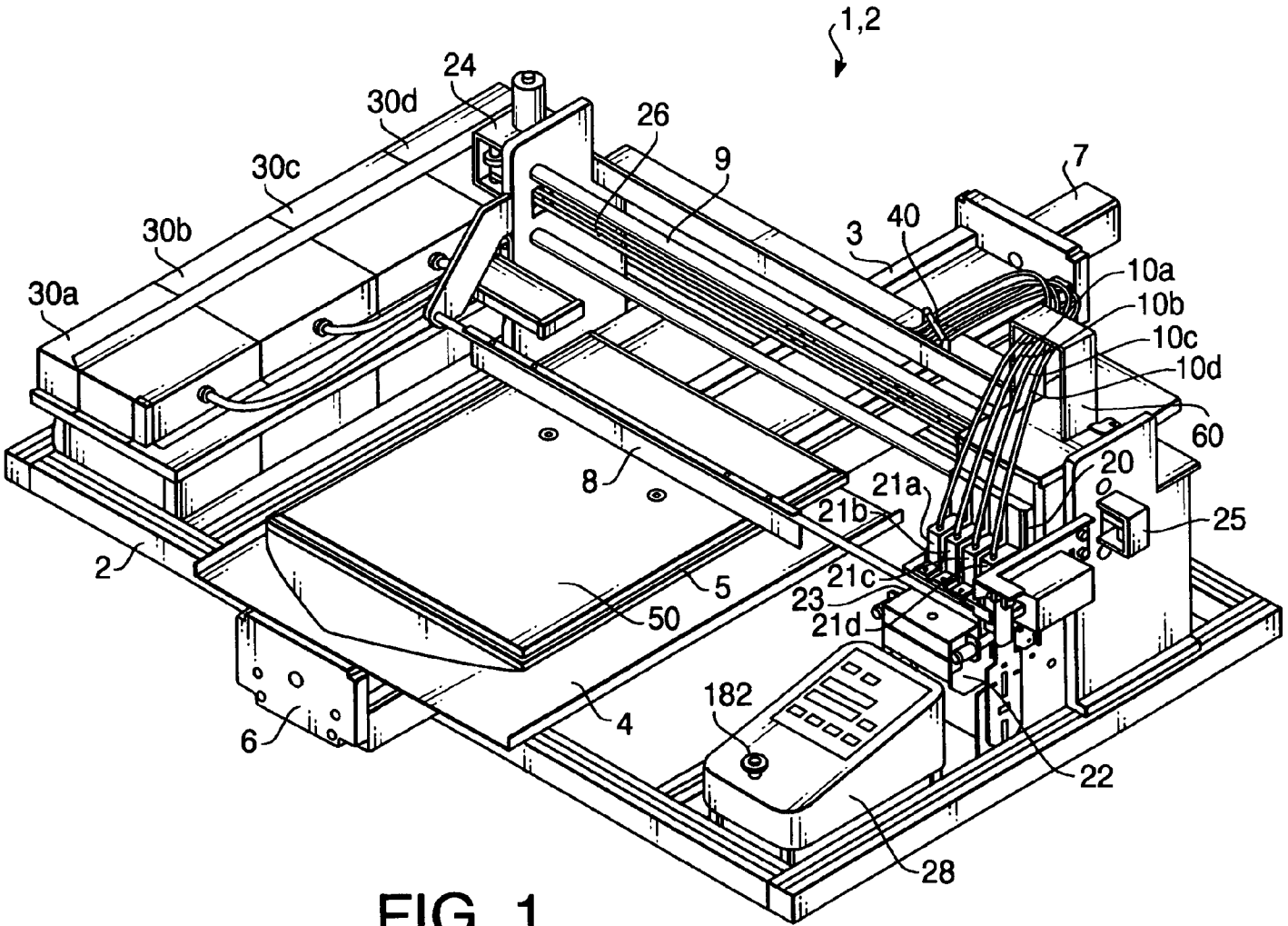
FIG. 1 is a perspective view of a fabric printer 1 according to a first embodiment of the invention.

Hereinafter, referring to accompanying drawings, embodiments of the present invention will be described. First, referring to FIG. 1, an entire configuration of a fabric printer 1 will be described. FIG. 1 is a perspective view of the fabric printer 1 according to the first embodiment of the invention. In the present embodiment, the fabric printer 1 is an inkjet printer for fabric as a recording medium communicably connected with a personal computer 200 (see FIG. 6) so that print data generated in the personal computer 200 can be transmitted thereto and output on the fabric. In the fabric printer 1 according to the present embodiment, four inks according to a CMYK format, which are cyan, magenta, yellow, and black, are used for printing.

As shown in FIG. 1, the fabric printer 1 includes a substantially box-shaped chassis 2 with two rails 3 aligned in parallel with a front-rear direction as indicated by an arrow at an approximate center of a bottom surface thereof. The rails 3 are supported by bases (not shown) which are positioned perpendicularly with respect to the bottom surface of the chassis 2. The rails 3 support a plate as a platen base (not shown) which is movable in the front-rear direction of the chassis along the rails 3. Further, the platen base is provided with a platen mount (not shown) that extends perpendicularly with respect to the platen base at a substantial center of the platen base. An exchangeable platen 5 is set on top of the platen mount.

The platen 5 is a substantially flat plate having a front side moderately protrude toward the front side in FIG. 1 and detachably attached to the platen mount with longer sides thereof aligned in parallel with the front-rear direction of the chassis 2, and clothing fabric as a recording medium is placed on the platen 5. A top surface of the platen 5 is provided with a fabric sheet member 50 which is made of, for example, a cotton cloth to prevent the fabric as a recording medium tensely placed on the platen 5 from being displaced during the printing operation. On top of the sheet member 50, the clothing fabric, for example a T-shirt, as a recording medium is substantially horizontally placed. It should be noted that the fabric printer 1 may be provided with a plurality of exchangeable platens 5, which are varied in sizes so that one of the platens 5 can be used according to, for example, a shape of the fabric to be printed.

In a position between the platen 5 and the platen base is provided a tray 4, which is fixed to the platen mount and has a bottom surface being substantially parallel with the top surface of the platen 5. The tray 4 is substantially larger than the platen 5 in a plan view. The tray 4 is provided so that a remaining part of the fabric other than the area to be printed such as sleeves of the T-shirt is received thereby and prevented from hanging over the bottom surface of the chassis 2 when the T-shirt is set on the platen 5.

A platen drive mechanism 6 includes the rails 3, along which the platen base is carried in the front-rear direction of the chassis 2 by a platen drive motor 7, as the platen motor 7 is provided at a rear end of the platen drive mechanism 6. As a drive shaft of the platen drive motor 7 and a pulley (not shown) provided in vicinity of front ends of the rails 3 are bound with a drive belt (not shown), the platen base fixed to the drive belt is reciprocated along the rails 3 by drive force generated by the platen drive motor 7.

At an approximate center of the chassis 2 in the front-rear direction, above the platen 5, a guide rail 9 to guide a carriage 20 with inkjet heads 21*a*-21*d* mounted is provided. In vicinity of a left-hand end of the guide rail 9, a carriage motor 24 to drive the carriage 20 is provided, while a pulley 25 is provided in vicinity of a right-hand end of the guide rail 9. Further, a carriage belt 26 is drawn between the carriage motor 24 and the pulley 25 under the guide rail 9. The carriage belt 26 is fixed to a rear surface of the carriage 20 so that the carriage 20 is reciprocated along the guide rail 9, which is coupled to the carriage 20 at a coupling portion (not shown) being fixed to the rear surface of the carriage 20 when the carriage motor 24 is activated. The carriage motor 24 is a DC motor, of which position on the guide rail 9 is detected by a linear encoder (not shown) provided to the guide rail 9.

In the fabric printer 1 according to the present embodiment, cyan ink, magenta ink, yellow ink, and black ink are used for image printing. Therefore, four ink cartridge storage units 30*a*-30*d*, wherein ink cartridges having the inks therein are detachably attached, are aligned on the left-hand side of the fabric printer 1. The ink cartridge units 30*a*-30*d* respectively include ink cartridges (not shown), each of which contains black ink, cyan ink, magenta ink, and yellow ink therein.

Each of the ink cartridge storage units 30*a*-30*d* is connected to one of the inkjet heads 21*a*-21*d* by ink supplying tubes 10*a*-10*d* so that the inks of the four colors stored in the ink cartridges are supplied to each channel of the inkjet heads 21*a*-21*d* passing under a guiding member 40 and a tube supporting member 60. The ink supplying tubes 10*a*-10*d* are flexible tubes which can be bent and twisted to a certain extent according to the movement of the carriage 20. The guiding member 40 holds the ink supplying tubes 10*a*-10*d* behind the carriage 20. The tube supporting member 60 holds the ink supplying tubes 10*a*-10*d* as well is provided at an upper surface of the carriage 20.

The carriage 20 is provided with the four piezoelectric inkjet heads 21*a*-21*d*. Each of the inkjet heads 21*a*-21*d* is provided with a plurality of (for example, 128) ejection channels (not shown) through which the ink is conveyed. Each of the channels is provided with a piezoelectric actuator (not shown), which is activated individually, to eject an ink drop downward onto the recording medium from ejection nozzles (not shown) that are open at nozzle surfaces of the inkjet heads 21*a*-21*d*. Thus, the black, cyan, magenta, and yellow inks stored in the ink cartridge storage units 30*a*-30*d* respectively are supplied to the inkjet heads 21*a*-21*d* through the ink supplying tubes 10*a*-10*d* and ejected from the ejection nozzles.

At a position corresponding to the carriage 20 being carried to the right-hand end of the guide rail 9, a purge unit 22 with a suction cap 23, which can be closely attached to and separated from the nozzle surfaces is provided. The purge unit 22 is provided with a suction pump (not shown) so that the inks remaining in the ejection nozzles can be replaced therefrom when the suction cap 23 is attached to the nozzle surfaces. Further, when the fabric printer 1 is not in a printing operation, the nozzle surfaces are covered by the suction cap 23 so that the inks in the nozzle surfaces can be prevented from being dried.

At a position toward the front from the guide rail 9, a clearance sensor 8, which extends in a direction substantially perpendicular to the front-rear direction, is provided. The clearance sensor 8 scans the surface of the fabric and detects an obstacle such as dust and a crease formed on the fabric set on the platen 5 when the platen 5 is carried along the rails 3 from a position at the downstream side to the upstream side of the rails 3 as the printing operation starts.

Figure 2:
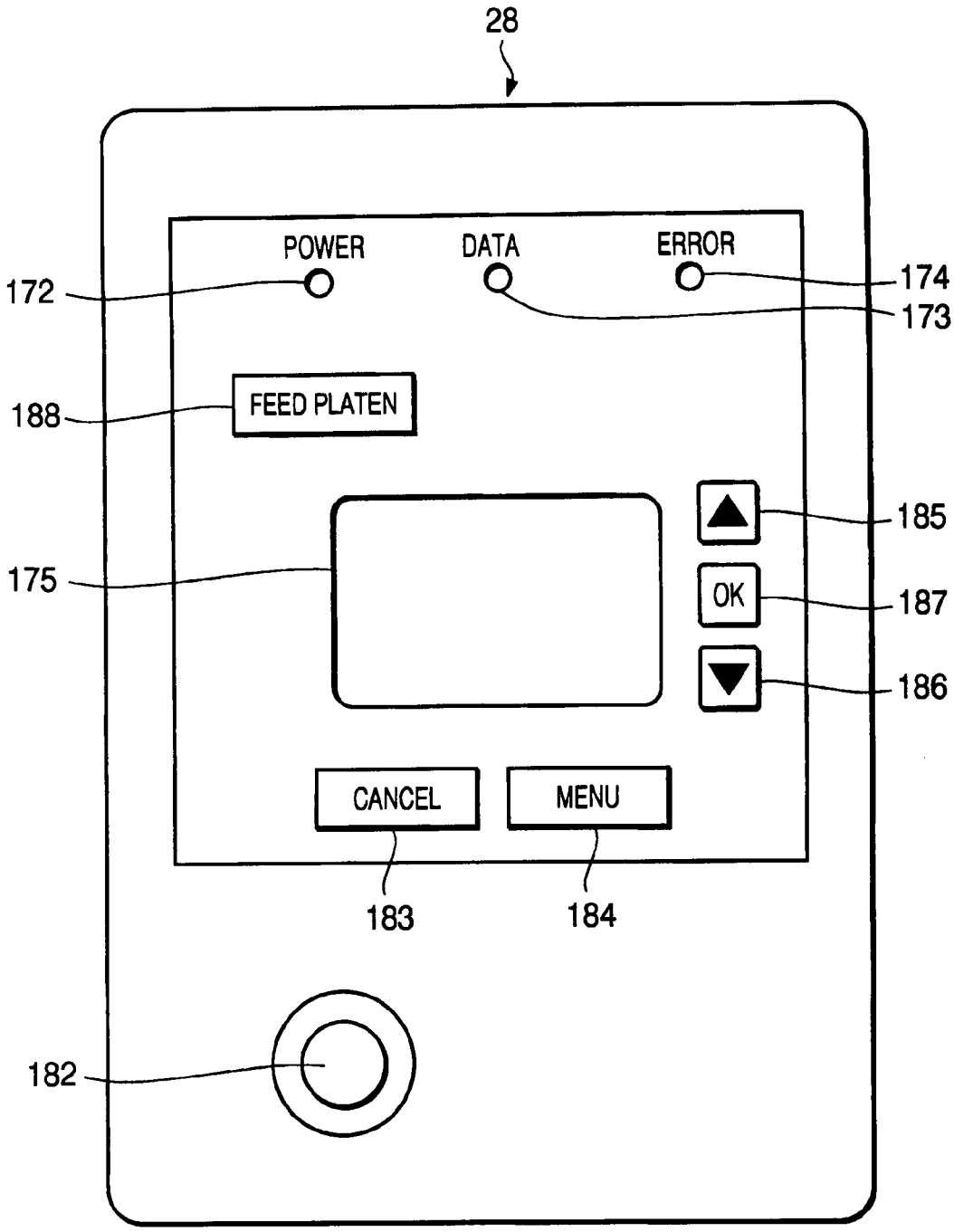
FIG. 2 is a plane view of an operation panel 28 according to the first embodiment of the invention.

At right-hand front of the chassis 2 is provided an operation panel 28 to which a user inputs an instruction for the fabric printer 1. Referring to FIG. 2, the operation panel 28 will be described. FIG. 2 is a plane view of the operation panel 28 according to the first embodiment of the invention. In an upper portion of the operation panel 28, a power indicator lamp 172, a data indicator lamp 173, an error indicator lamp 174 are provided. The power indicator lamp 172 turns on when the fabric printer 1 is powered, and the data indicator lamp 173 is turned on when the fabric printer 1 is receiving print data from the personal computer 200. The error indicator lamp 174 is turned on when an error has occurred in the fabric printer 1. The operational panel 28 is further provided with a platen feed button 188 in a position approximately below the power indicator lamp 172. When the platen feed button 188 is pressed, the platen 5 is moved to a position wherein the recording medium such as a T-shirt can be set on and removed from the platen 5.

The operational panel 28 further includes a display 175 in a position approximately below the platen feed button 188. On the display 175, information regarding the print data such as a name and a size of the data being received in the fabric printer 1 transmitted from the personal computer 200 is displayed as the fabric printer 1 is in one of various states such as a data receiving state, a print ready state, a printing state, and a print completion state, for example. Also, a menu screen (not shown) to prompt the user's input regarding various settings and details of an error when an error occurs, are displayed on the display 175. Further, in the display 175, layout for positioning index that is to be printed on the sheet member 50 is displayed. Further, on a right-hand side of the display 175, an up arrow button 185, an OK button 187, and a down arrow button 186 are provided, while a cancel button 183 and a menu button 184 are provided in positions approximately below the display 175. When the menu button 184 is pressed, the menu screen is displayed on the display 175, and a cursor shown on the display 175 is moved upward and downward as the up arrow button 185 and the down arrow button 186 are pressed. Upon pressing the OK button 187, an item being selected by the cursor is entered.

In a lower portion of the operational panel 28, a print button 182, which is pressed when an instruction to start printing is given to the fabric printer 1, is provided. When the print button 182 is pressed by the user, a printing operation to print the print data received from the personal computer 200 is started. When the cancel button 183 is pressed during the printing operation, the printing operation is canceled.

Figure 3:
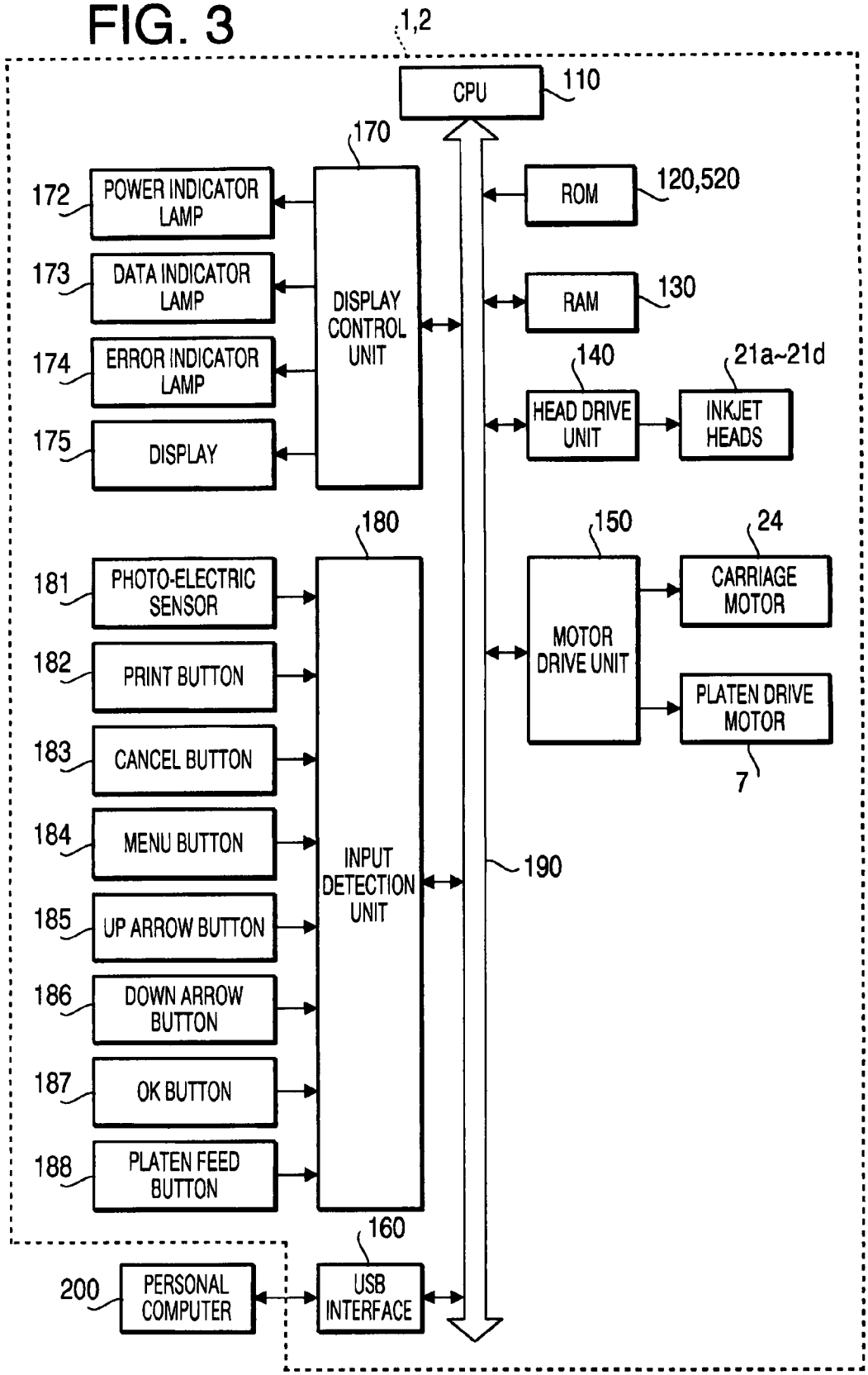
FIG. 3 is a block diagram showing an electrical configuration of the fabric printer 1 according to the first embodiment of the invention.
Figure 4:
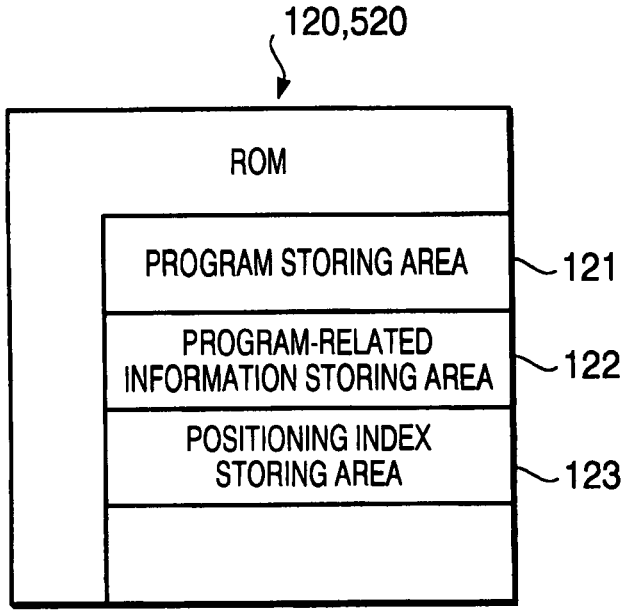
FIG. 4 illustrates a configuration of a ROM 120 in a control unit of the fabric printer 1 according to the first embodiment of the invention.
Figure 5:
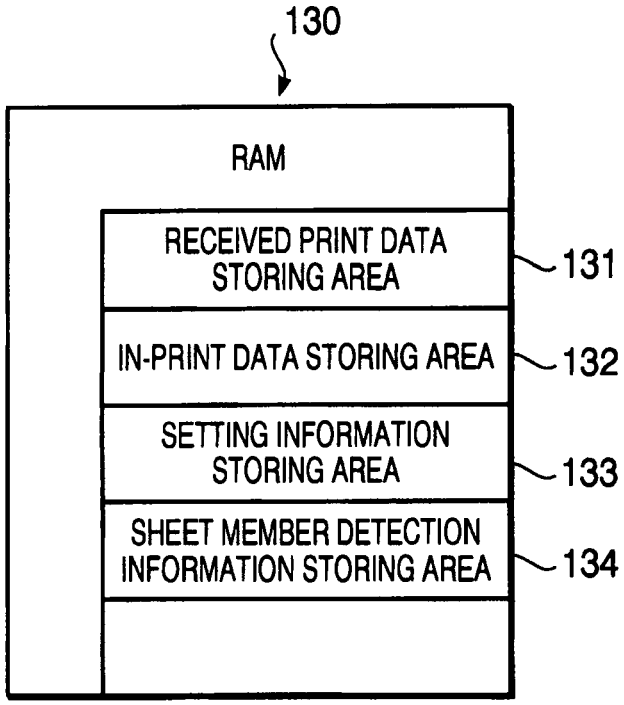
FIG. 5 illustrates a configuration of a RAM 130 in the control unit of the fabric printer 1 according to the first embodiment of the invention.

Next, referring to FIGS. 3-5, an electrical configuration of the fabric printer 1 will be described. FIG. 3 is a block diagram showing the electrical configuration of the fabric printer 1 according to the first embodiment of the invention. FIG. 4 illustrates a configuration of a ROM 120 of the fabric printer 1 according to the first embodiment of the invention. FIG. 5 illustrates a configuration of a RAM 130 of the fabric printer 1 according to the first embodiment of the invention.

As shown in FIG. 3, the fabric printer 1 is provided with a CPU 110 that controls the entire operation in the fabric printer 1. The CPU 110 is connected with the ROM 120 and the RAM 130 via a bus 190.

The CPU 110 is further connected with a head drive unit 140, which activates the piezoelectric actuators being provided to each channel of the inkjet heads 21*a*-21*d* and a motor drive unit 150, which controls a carriage motor 24 and a platen drive motor 7. The carriage motor 24 drives the carriage 20 having the inkjet heads 21*a*-21*d*, and the platen drive motor 7 drives a platen roller (not shown), which adjusts timing and speed to feed the platen 5 holding the fabric as a recording medium. The CPU 110 is further connected to a USB interface 160, which allows communication between the fabric printer 1 and external devices including the personal computer 200 through a USB cable (not shown).

The operation panel 28 (see FIGS. 1 and 2) is provided with the display 175, a power indicator lamp 172, a data indicator lamp 173, and an error indicator lamp 174. A display control unit 170 which executes displaying processes of these indicators is connected to the CPU 110 through the bus 190. The CPU 110 is further connected with a photoelectric sensor 181, which detects as to whether the sheet member 50 is properly installed on the platen 5, and an input detection unit 180, which detects input through operation buttons including the print button 182, the cancel button 183, the menu button 184, the up arrow button 185, the down arrow button 186, the OK button 187, and the platen feed button 188, via the bus 190. The photoelectric sensor 181 is configured with, for example, a CCD (charge-coupled device), a photo transistor, or a CdS, and is provided to the carriage 20 in a position to oppose to the platen 5. The photoelectric sensor 181 detects higher intensity of light when the sheet member 50 with a white surface is installed on the platen 5, while it detects lower intensity of light when no sheet member 50 is installed. It should be noted that the carriage 20 may be provided with a light emitting system such as an LED (light-emitting diode) so that the light emitted from the light emitting system and reflected on a surface of the platen 5 (or a surface of the sheet member 50 when the sheet member 50 is installed) is detected by the photoelectric sensor 181.

Next, referring to FIG. 4, a storing area of the ROM 120 will be described. As shown in FIG. 4, the ROM 120 includes a program storing area 121, a program-related information storing area 122, and a positioning index storing area 123. The program storing area 121 stores various programs such as a controlling program to control operations of the fabric printer 1 and a print execution program to execute a printing operation. The program-related information storing area 122 stores information such as initial settings and values required for executing the programs. The positioning index storing area 123 stores a plurality of patterns of positioning indexes, which are printed on the sheet member 50. Further, the ROM 120 is provided with various storing areas, which are not shown. In the positioning index storing area 123, a plurality of patterns of the positioning indexes, each of which corresponds a type of the fabric as a recording medium, such as a shirt, a blouse, a coverall, a T-shirt, and a sweatshirt, for example, are stored.

Next, referring to FIG. 5, a storing area of the RAM 130 will be described. The RAM 130 in the fabric printer 1 is provided with several areas including a received print data storing area 131 for storing the print data received from the personal computer 200, an in-printing data storing area 132 for storing the print data being printed, a setting information storing area 133 for storing various setting information, and a sheet member detection information storing area 134 for storing a detection result for the sheet member 50. Further, the RAM 130 is provided with various storing areas, which are not shown.

Figure 6:
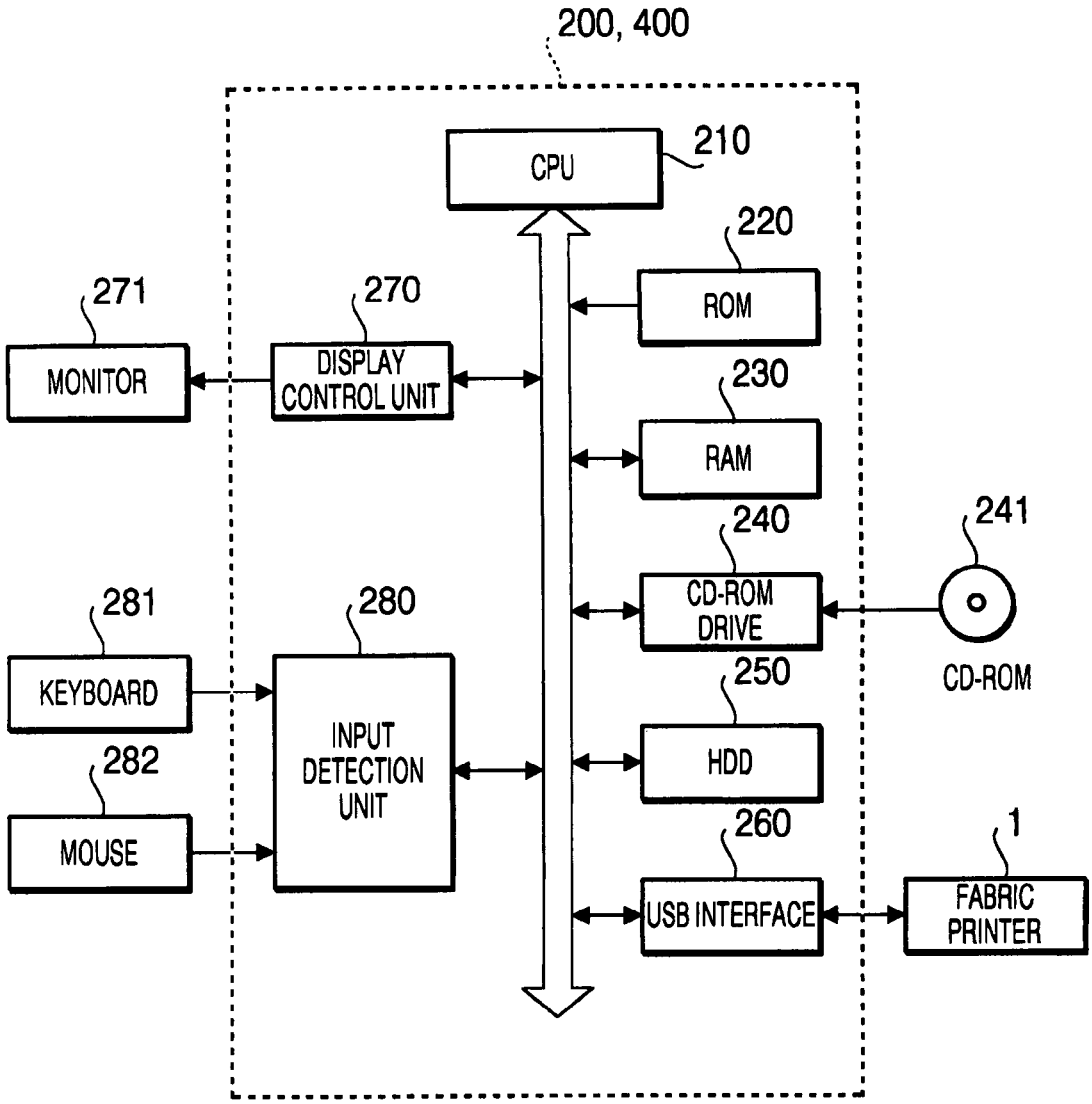
FIG. 6 is a block diagram showing an electrical configuration of a personal computer 200 according to the first embodiment of the invention.
Figure 7:
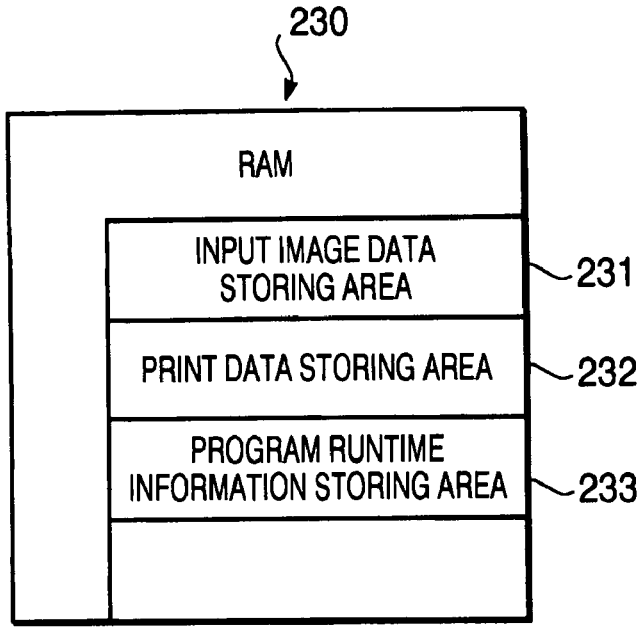
FIG. 7 illustrates a configuration of a RAM 230 of the personal computer 200 according to the first embodiment of the invention.
Figure 8:
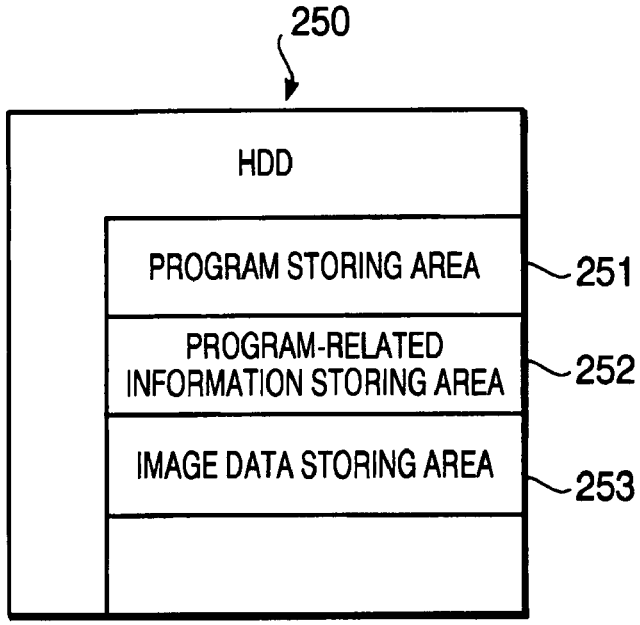
FIG. 8 illustrates a configuration of a storing area in an HDD (hard disk drive) 250 of the personal computer 200 according to the first embodiment of the invention.

Next, referring to FIGS. 6 through 8, a configuration of the personal computer 200 will be described. FIG. 6 is a block diagram of an electrical configuration of the personal computer 200 according to the first embodiment of the invention. FIG. 7 is a schematic diagram of a RAM 230 in the personal computer 200 according to the first embodiment of the invention. FIG. 8 is a schematic diagram of an HDD 250 in the personal computer 200 according to the first embodiment of the invention. The personal computer 200 is connected to the fabric printer 1 through a standardized communication cable, for example a USB. In the personal computer 200, the print data is generated based on image data, which is created for example by the user using various graphic applications, by scanning an image with a scanner, and by captured by photographing with a digital camera. The generated print data is transmitted to the fabric printer 1.

As shown in FIG. 6, the personal computer 200 is provided with a CPU 210 that controls the entire operation in the personal computer 200. The CPU 210 is connected with a ROM 220, wherein various information such as a BIOS executed by the CPU 210 is stored, and a RAM 230, wherein various information is temporally stored via a bus 290. Further, a CD-ROM drive 240 for reading data from a CD-ROM 241 inserted therein as a storage medium of data, and the HDD 250 which is a storage unit for data, through a bus 290, are connected to the CPU 210.

The CPU 210 is further connected to a USB interface 260, which allows communication between the personal computer 200 and external devices including the fabric printer 1 through a USB cable (not shown). The CPU 210 is furthermore connected to a display control unit 270 which executes displaying processes to display an operation screen on a monitor 271, input devices including a keyboard 281 and a mouse 282 which are operated by the user, and an input detection unit 280 which executes detecting of these inputs. It should be noted that the personal computer 200 is also provided with other units such as a floppy (registered trademark) disk drive, an audio input-output unit, and various interfaces.

In the CD-ROM 241, a print data creating program and information regarding settings and data to be used for executing the program are stored. Such a program and the information are stored (copied) from the CD-ROM 241 in a program storing area 251 (see FIG. 8) and a program-related information storing area 252 (see FIG. 8) in the HDD 250, at the time of installation. It should be noted that such information the printer driver for the personal computer 200 and the other information can be obtained in the other method than obtaining from the CD-ROM 241. For example, other recording media such as a flexible disk and an MO (magnet-optical) disk are also available. Further, the information may be obtained from a terminal on a same network by connecting the personal computer 200 to the network.

As shown in FIG. 7, the RAM 230 is provided with several areas including an input image data storing area 231 for temporarily storing image data based on for creating the print data, a print data storing area 232 for storing the print data generated by a print data generating program based on the image data, and a program runtime information storing area 233 for storing temporarily the other data to be used during execution of other programs. Further, the RAM 230 includes various storing areas, which are not shown.

As shown in FIG. 8, the HDD 250 is provided with several areas including a program storing area 251 for storing various programs to be executed in the personal computer 200, a program-related information storing area 252 for storing information regarding settings, initial values, and data necessary for executing programs to be used with a profile for color-matching (i.e., a color conversion table), and an image data storing area 253 for storing image data. Further, the HDD 250 includes various storing areas, which are not shown. In the program storing area 251, a plurality of patterns of the positioning indexes, each of which corresponds a type of the fabric as a recording medium, such as a shirt, a blouse, a coverall, a T-shirt, and a sweatshirt, for example, are stored.

With the aforementioned configuration of the fabric printer 1 according to the embodiment, as the print data generating data is executed and the print data is transmitted from the personal computer 200, and the fabric printer 1 starts receiving the print data, the data indicator lamp 173 turns on. Further, information regarding the print data is displayed on the display 175. As the fabric printer 1 completes receiving the print data, the user sets a T-shirt on the platen 5 and presses the print button 182. Accordingly, the platen 5 is moved to rearward of the chassis 2 along the rails 3 by the platen driving motor 7 so that the position of the carriage 20 with respect to the platen 5 corresponds to a recording start position. Thereafter, the inkjet heads 21*a*-21*d* eject the inks as the carriage 20 is moved from the right-hand side to the left-hand side of the chassis 2 according to a recording instruction so that recording of one line is executed. Further, the platen 5 is moved to frontward from the rearward of the chassis 2 for an amount corresponding to one line, and the inkjet heads 21*a*-21*d* eject the inks as the carriage 20 is moved from the right-hand side to the left-hand side of the chassis 2 according to the recording instruction so that recording of the next line is executed. Subsequently, the platen 5 is moved to frontward from the rearward of the chassis 2 for the amount corresponding to another one line portion. By repeating this operation, printing the image onto the T-shirt is executed. At the end of the printing operation, the platen 5 is fed forth to a position wherein the T-shirt can be removed, thus the user removes the T-shirt which underwent the printing operation. A height of one line to be printed in one movement of the carriage 20 from the right-hand side to the left-hand side (i.e., a number of pixels in the feeding direction of the platen 5) may be either one pixel or a plurality of pixels.

In the fabric printer 1 according to the present embodiment, four types of inks, which are cyan, magenta, yellow, and black, are used in the printing operation. Further, the printing operation can be provided with two printing modes, which are a normal printing mode and a positioning index printing mode. In the normal printing mode, the print data generated in the personal computer 200 is output to be printed on the fabric such as a T-shirt as a recording medium by ejecting the inks from the inkjet heads 21*a*-21*d*. In the positioning index printing mode, positioning index which is represented by, for example, a plurality of marker lines to indicate positions whereto the fabric is aligned is printed on the sheet member 50 installed on the platen 5.

Next, a color of an ink to be used for a printing operation in the positioning index printing mode will be described. The color of the ink for the positioning index printing mode is required to have substantial differences in brightness and in saturation from those of the sheet member 50 so that visibility of the ink on the sheet member 50 is ensured. Further, the ink should be prevented from exuding and smearing the fabric. Specifically, it is preferable that an L* value of the brightness of the ink is 70 or less, when an L* value of the recording medium which is white is 90 or more.

In order to achieve visibility of the ink to a certain extent, a hue of the ink should be a red which falls in a range between reddish yellow (orange) to purplish red, and it is preferable that an a* value is +30 or more. Substantial visibility may not be achieved if the hue is for example blue or black, which are shadow colors. In the present embodiment, a purplish red (dark pink) is used as the ink for the positioning index, and magenta 30% (i.e., an L* value for the L*a*b* value is 57.80, an a* value is 49.68, and a b* value is 7.20 when printed on the sheet member 50 and measured by X-Rite (registered trademark) 939 spectro-densitometer) is used. In the present embodiment, magenta 30% refers to a composition of the inks to be ejected, wherein 30% of an area to be printed is covered by the magenta ink. In addition, visibility of the positioning index printed on the fabric as a recording medium, which is Beefy-T (registered trademark) white T-shirt, 6.1 oz, manufactured by Hanes (registered trademark), is referenced as a standard in the present embodiment.

Figure 9:
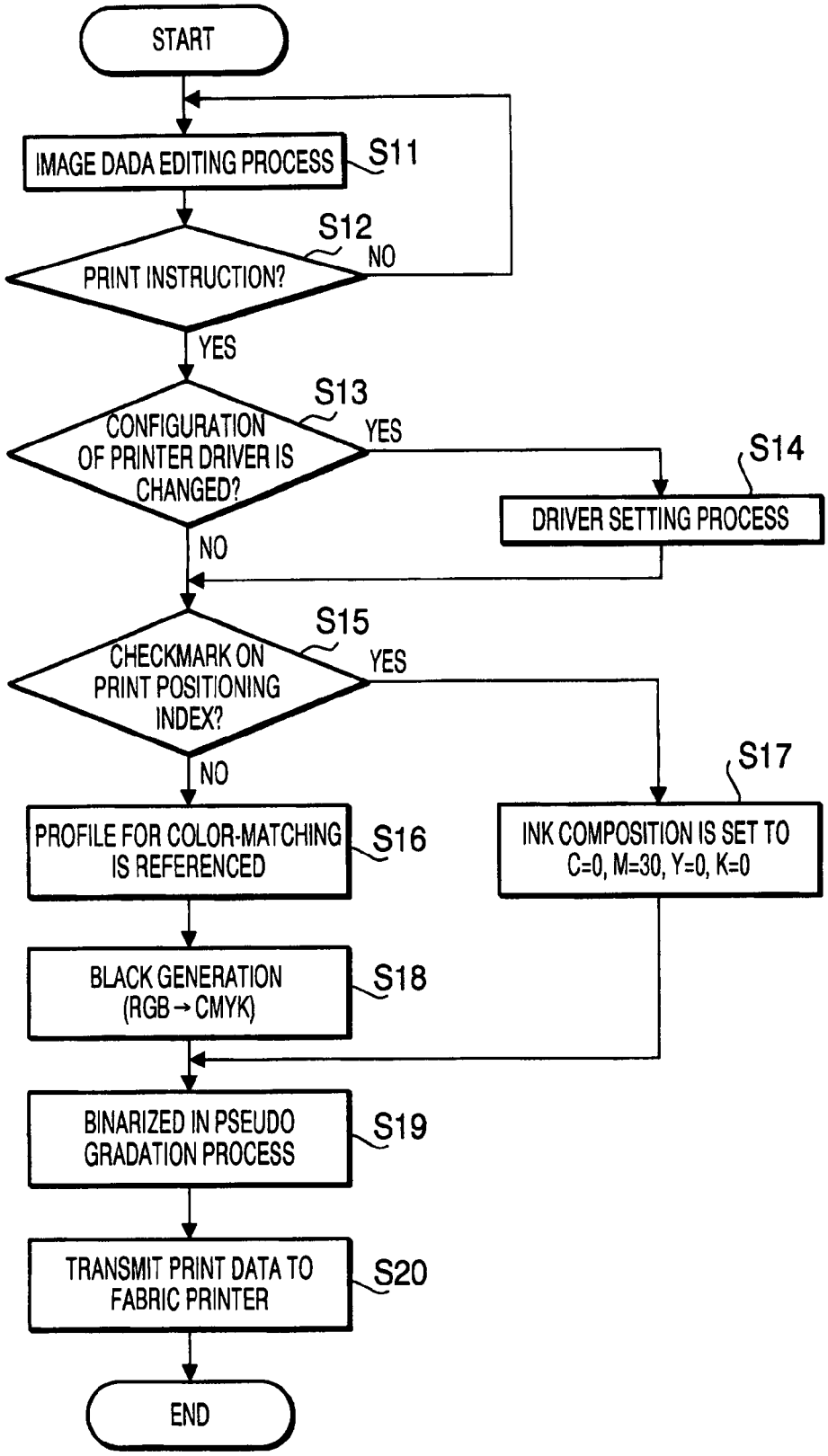
FIG. 9 is a flowchart of a process of the personal computer 200 as image data is generated and transmitted to the fabric printer 1 according to the first embodiment of the invention.
Figure 10:
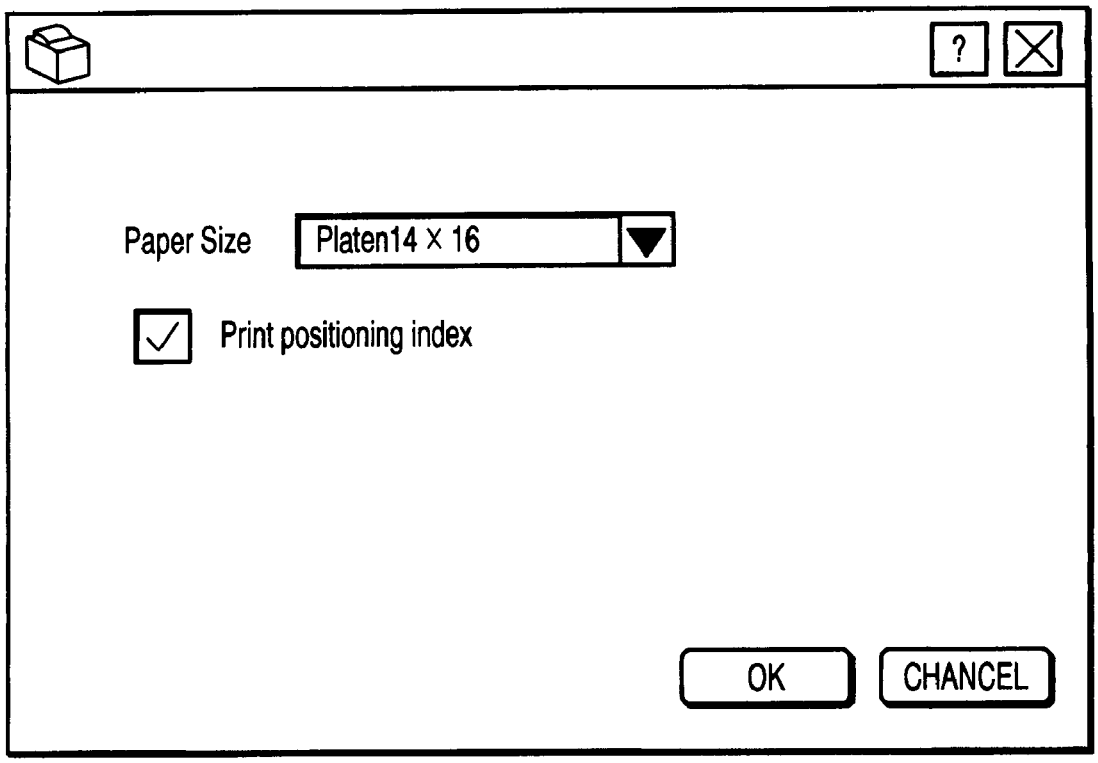
FIG. 10 illustrates a setting screen for positioning index for printer driver of the fabric printer 1 according to the first embodiment of the invention.
Figure 11:
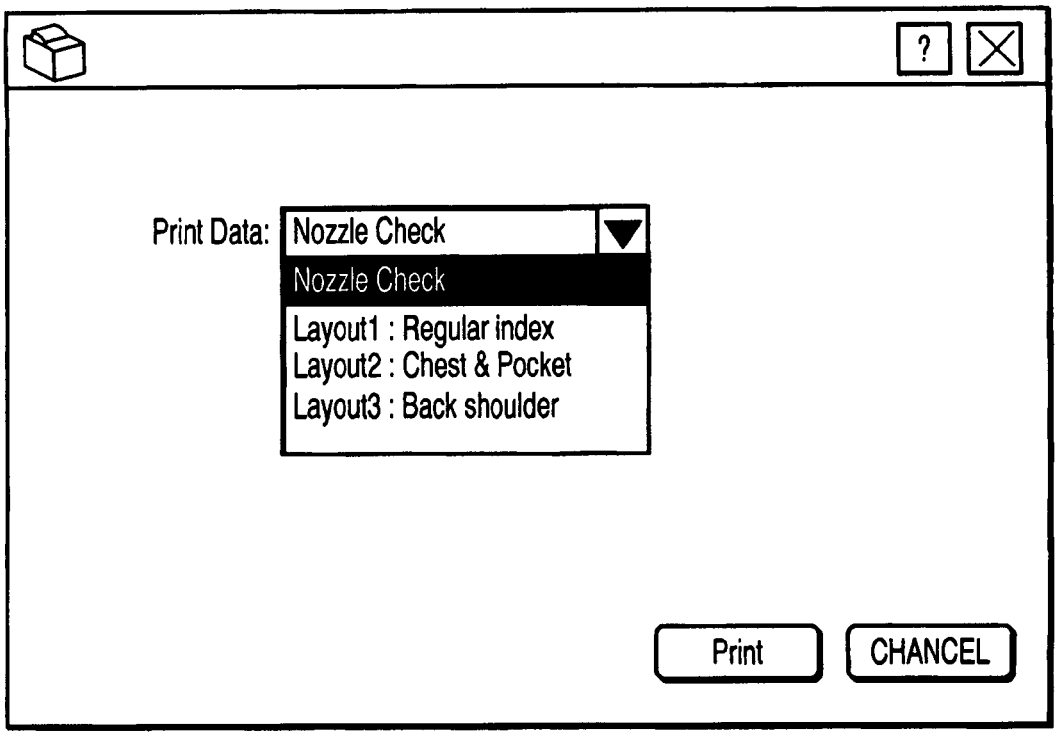
FIG. 11 illustrates a setting screen for selecting positioning index for printer driver of the fabric printer 1 according to the first embodiment of the invention.

Next, referring to FIGS. 9 through 11, a process for generating image data and setting positioning index to be executed in the personal computer 200 will be described. FIG. 9 is a flowchart of a process of the personal computer 200 as the image data is generated and transmitted to the fabric printer 1 according to the first embodiment of the invention. FIG. 10 illustrates a setting screen for the positioning index for printer driver of the fabric printer 1 according to the first embodiment of the invention. FIG. 11 illustrates a setting screen for selecting the positioning index for the printer driver of the fabric printer 1 according to the first embodiment of the invention.

As an image data generating process is started in the personal computer 200, in S11, an image data editing process is executed so that the image data representing an image to be printed on the fabric is suitably edited. The image data editing process is executed by using a commercially available image data editing software. The edited image data is stored in the image data storing area 253 of the HDD 250. Next, in S12, it is judged as to whether an instruction for printing is given. When the instruction is given (S12: YES), next, in S13, it is judged as to whether a property of the printer is to be changed (i.e., the user selects to change a configuration of the printer driver in a print instruction screen). When the user selects to change the configuration (S13: YES), next, in S14, the configuration of the printer driver is changed in a driver setting process. Specifically, in the driver setting process, when the user desires to print the positioning index on the sheet member 50, the user places a checkmark in a checkbox indicating an instruction to print the positioning index, which is a checkbox labeled as "print positioning index" in a menu screen for the printer driver shown in FIG. 10. With this information indicated by the checkmark, a flag is set on in a "print positioning index" field in the program runtime information storing area 233. Subsequently, in the menu screen for the printer driver, the user is prompted to select a positioning index to be printed among a plurality of positioning indexes shown. When the user specifies one of the positioning indexes and clicks on a "Print" button, the positioning index to be printed is entered, and information corresponding to the selected positioning index is read from the program storing area 251 of the HDD 250 (see FIG. 8). Further, the information read from the program storing area 251 is stored in the program runtime information storing area 233. The process proceeds to S15.

In S13, when it is determined in the print instruction screen that the configuration of the printer driver is not to be changed, and a print instruction is given (S13: NO), the process proceeds to S15. In S15, in the print setting screen for the positioning index, it is judged as to whether a checkmark to indicate an instruction to print the positioning index is placed. The judgment is made by examining the flag in the "print positioning index" field in the program runtime information storing area 233. When the flag is set on (S15: YES), in S17, a composition of inks to be ejected for the image to be printed is set. In the composition of the inks in the present embodiment, cyan is 0%, magenta is 30%, yellow is 0%, and black is 0%. Further, in S19, the positioning index stored in the program runtime information storing area 233 of the RAM 230 is binarized in two-color scale by a pseudo gradation process, and in S20, the binarized image data is transmitted to the fabric printer 1. As previously mentioned, in the present embodiment, the ink composition of magenta 30% refers to a composition of the inks to be ejected, wherein 30% of an entire area to be printed is covered by the magenta ink, and no other ink is ejected on the area.

In S15, when no flag is set in the print positioning index field stored in the program runtime information storing area 233 of the RAM 230 (S15: NO), the positioning index is not printed on the sheet member 50. Therefore, in S16, the profile for color-matching stored in the program-related information storing area 252 in the HDD 250 is referenced, and in S18, a black generation process is performed, wherein the image data in the RGB format generated in S11 and stored in the image data storing area 253 of the HDD 250 is converted into the CNYK format for the inks to be used in the printing operation. Next, in S19, the image data in the CMYK format is binarized in two-color scale by the pseudo gradation process, and in S20, the binarized print data is transmitted to the fabric printer 1. The data received in the fabric printer 1 is stored in the received print data storing area 131 of the RAM 130.

Figure 12:
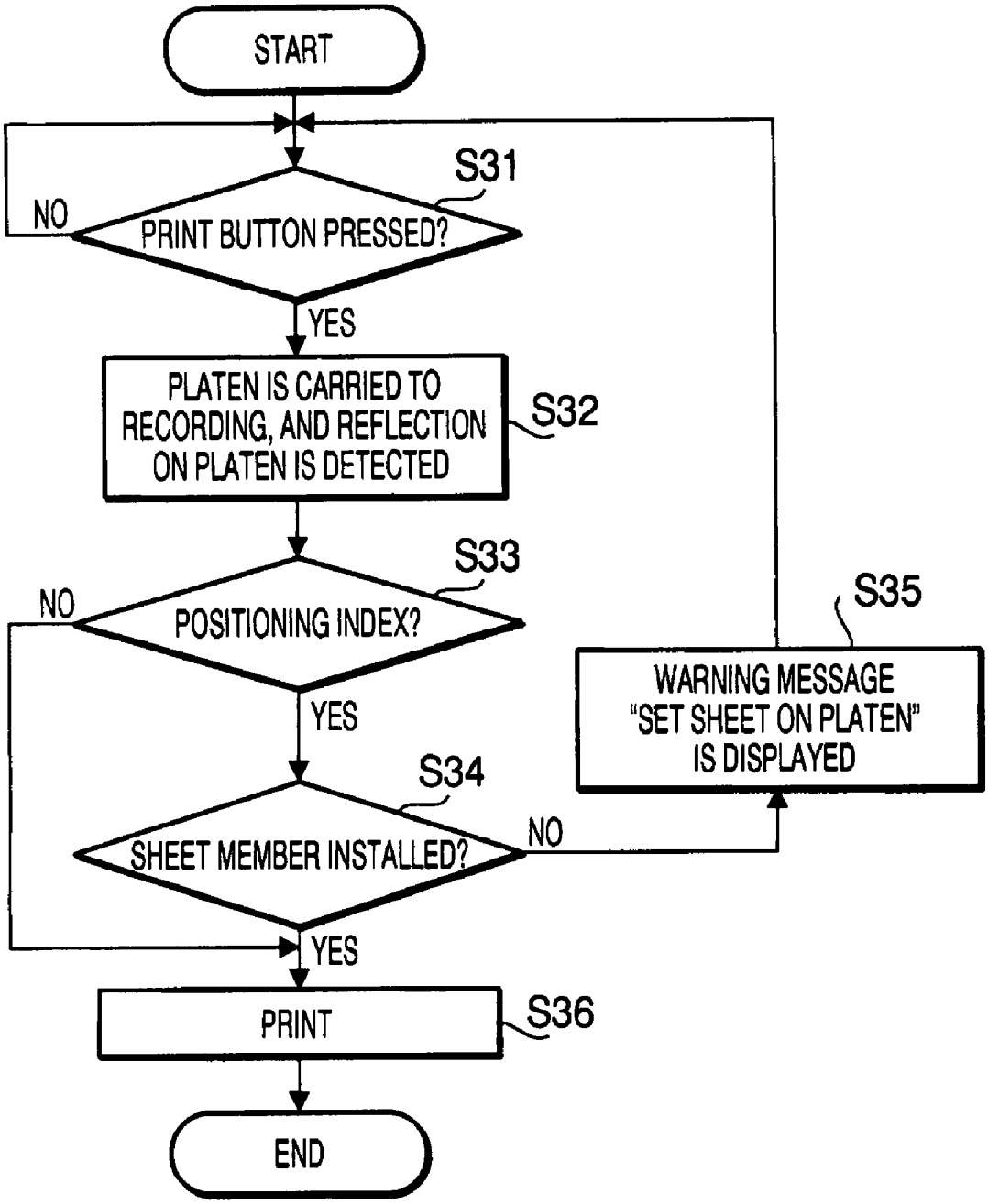
FIG. 12 is a flowchart of a printing process executed by the fabric printer 1 according to the first embodiment of the invention.

Next, referring to FIG. 12, a printing process executed in the fabric printer 1 will be described. FIG. 12 is a flowchart of the printing process executed by the fabric printer 1 according to the present embodiment of the invention. As the fabric printer receives the print data transmitted from the personal computer 200, in S31, it is judged as to whether the print button 182 (see FIG. 2) has been pressed. When the print button 182 has not been pressed (S31: NO), the fabric printer 1 waits until the print button 182 is pressed. This step is provided in order to prevent the fabric printer 1 from recording the image immediately after receiving the print data. It should be noted that in the fabric printer 1, fabric such as a T-shirt is used as a recording medium, unlike a printer which records an image onto paper as a recording medium. Therefore, if the fabric is not properly positioned on the platen 5 when the fabric printer 1 starts recording immediately after receiving the print data, the image may be recorded in an undesired position on the fabric. In such a case, the fabric which is generally more expensive than paper may be wasted. Thus, the step to judge as to whether the print button 182 has been pressed is provided in the printing process in order to prevent the fabric from being wasted.

In S31, if the print button 182 has been pressed (S31: YES), in S32, the platen 5 that supports the fabric is carried to a position wherein the recording is started. In this step, the reflection on the platen 5 is detected by the photoelectric sensor 181.

Figure 13:
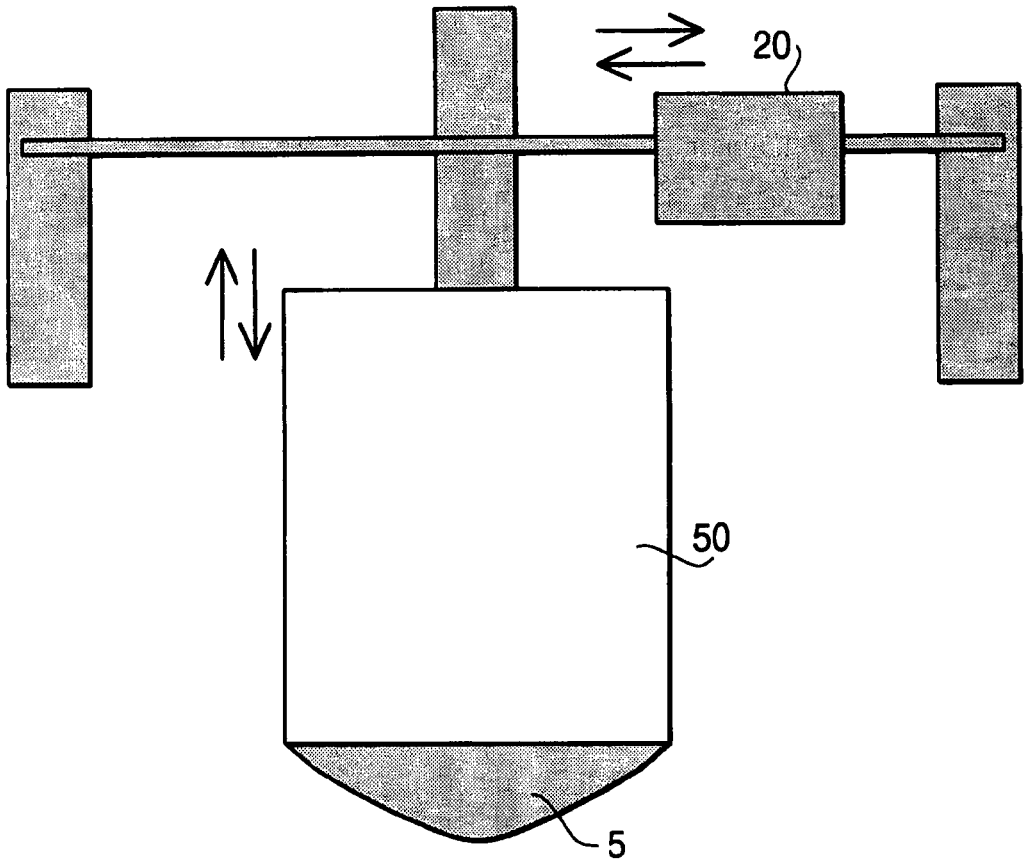
FIG. 13 is a plan view of a platen 5 with a white sheet member 50 set thereon according to the first embodiment of the invention.
Figure 14:
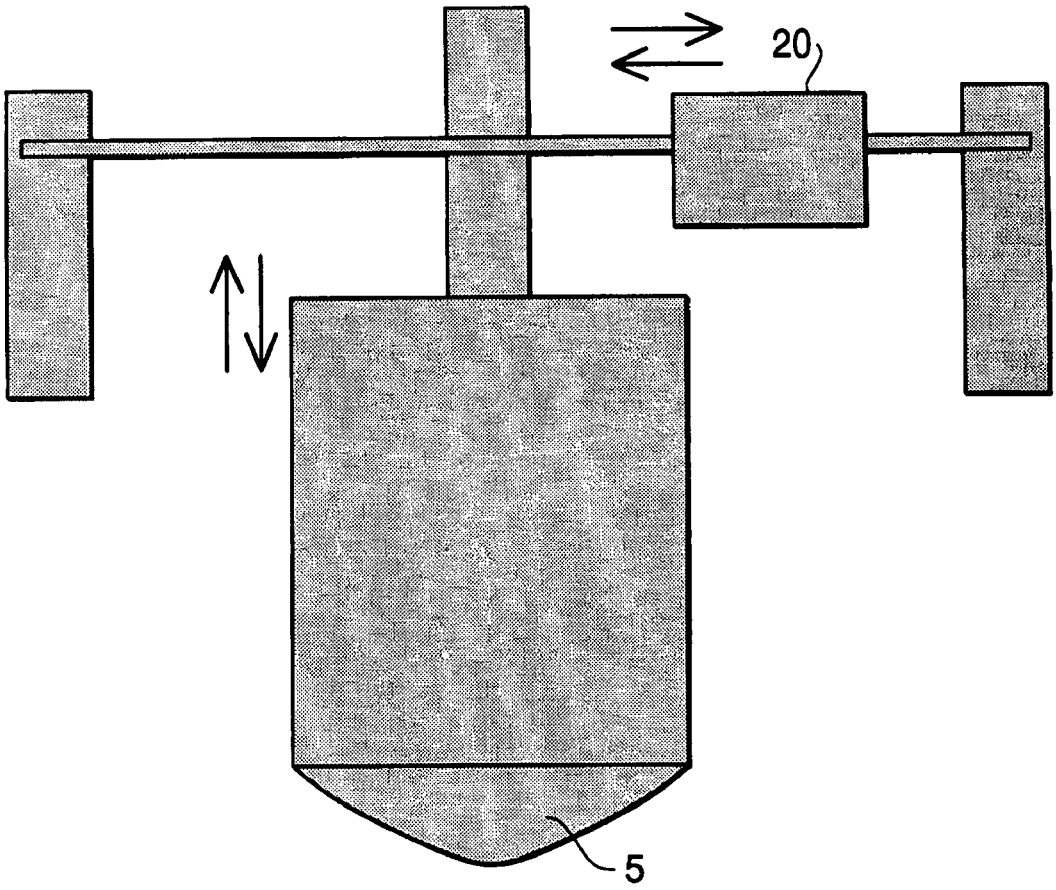
FIG. 14 is a plan view of the platen 5 without the white sheet member 50 thereon according to the first embodiment of the invention.

Now, referring to FIGS. 13 and 14, the photoelectric sensor 181 that detects reflection on the sheet member 50 will be described. FIG. 13 is a plan view of the platen 5 with the sheet member 50 set thereon according to the present embodiment of the invention. FIG. 14 is a plan view of the platen 5 without the sheet member 50 thereon according to the present embodiment of the invention. As shown in FIG. 13, when the white sheet member 50 is installed on the platen, an amount of the light reflected on the sheet member 50 to be detected by the photoelectric sensor 181 while the platen 5 is carried to the recording position in S32 is greater than the light reflected on the platen 5 being carried to the recording position without the sheet member 50 to be detected by the photoelectric sensor 181 as shown in FIG. 14. In S32, the detected amount of reflection is stored in the sheet member detection information storing area 134 of the RAM 130.

Next, in S33, it is judged as to whether the print data received and stored in the received print data storing area 131 (see FIG. 5) of the RAM is the positioning index. When the print data is the positioning index (S33: YES), in S34, it is judged as to whether the sheet member 50 is installed on the platen 5. The judgment is made based on a detected result obtained from the photoelectric sensor 181. When the detected value stored in the sheet member detection information storing area 134 of the RAM 130 is greater than a predetermined reference value, it is determined that the sheet member 50 is installed on the platen 5 (S34: YES). Thereafter, in S36, the positioning index is printed on the sheet member 50. In S34, when the detected value is less than the predetermined reference value, it is determined that the sheet member 50 is not installed on the platen 5 (S34: NO), and in S35, a warning message such as "Set sheet on platen" is displayed on the display 175. In S33, when it is determined that the received print data is not the positioning index (S33: NO), it is determined that the print data is print data for normal printing, therefore, in S36, the print data is printed on the fabric as a recording medium. It should be noted that the predetermined reference value is previously determined based on a value indicating the amount of the light reflected on the sheet member 50 and a value indicating the amount of the light reflected on the platen 5, which are stored in the program-related information storing area 122, so that presence and absence of the sheet member 50 can be distinguished.

Figure 15:
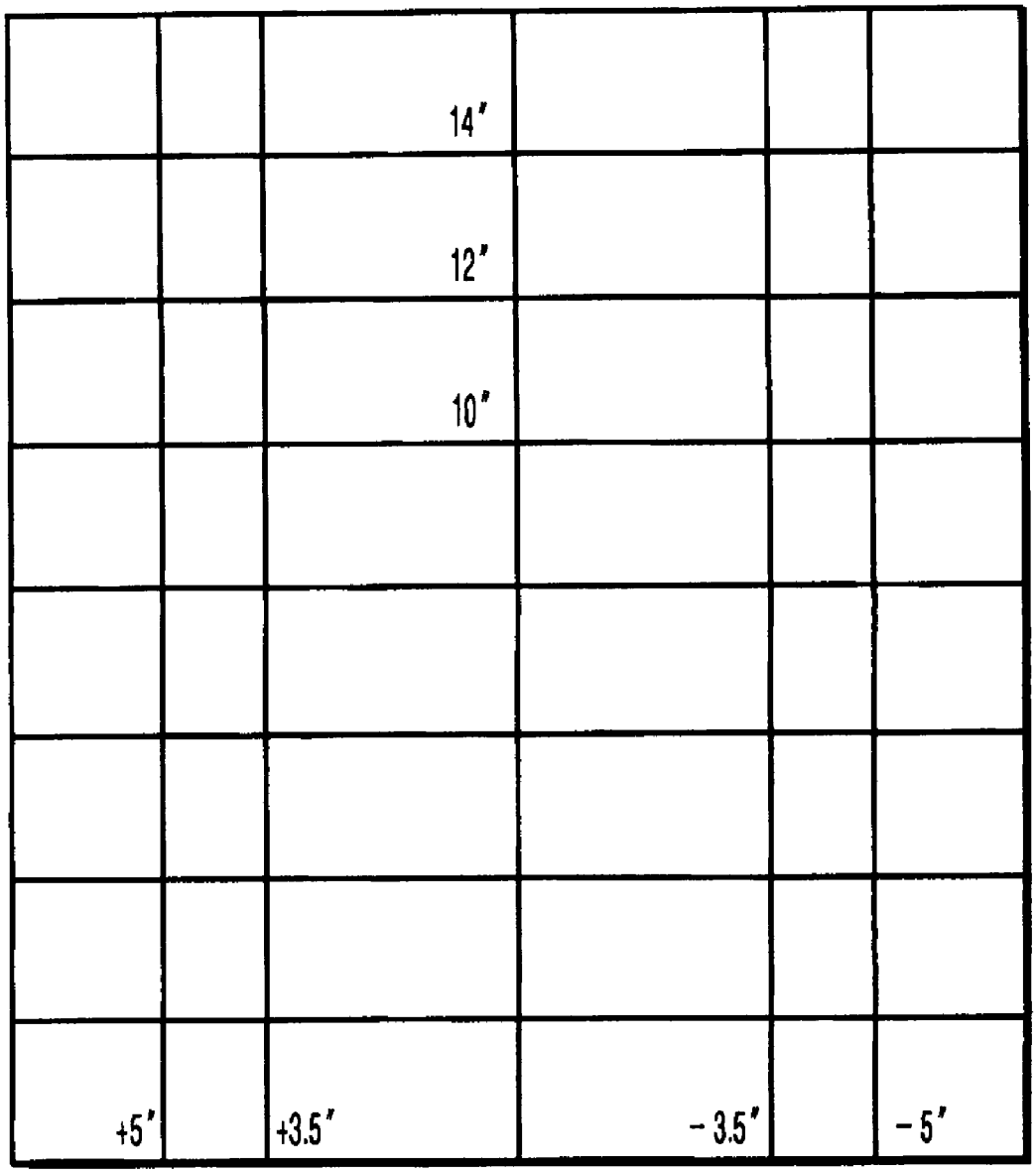
FIG. 15 is an illustrative plane view of the sheet member 50 with first positioning index printed thereon according the first embodiment of the invention.
Figure 16:
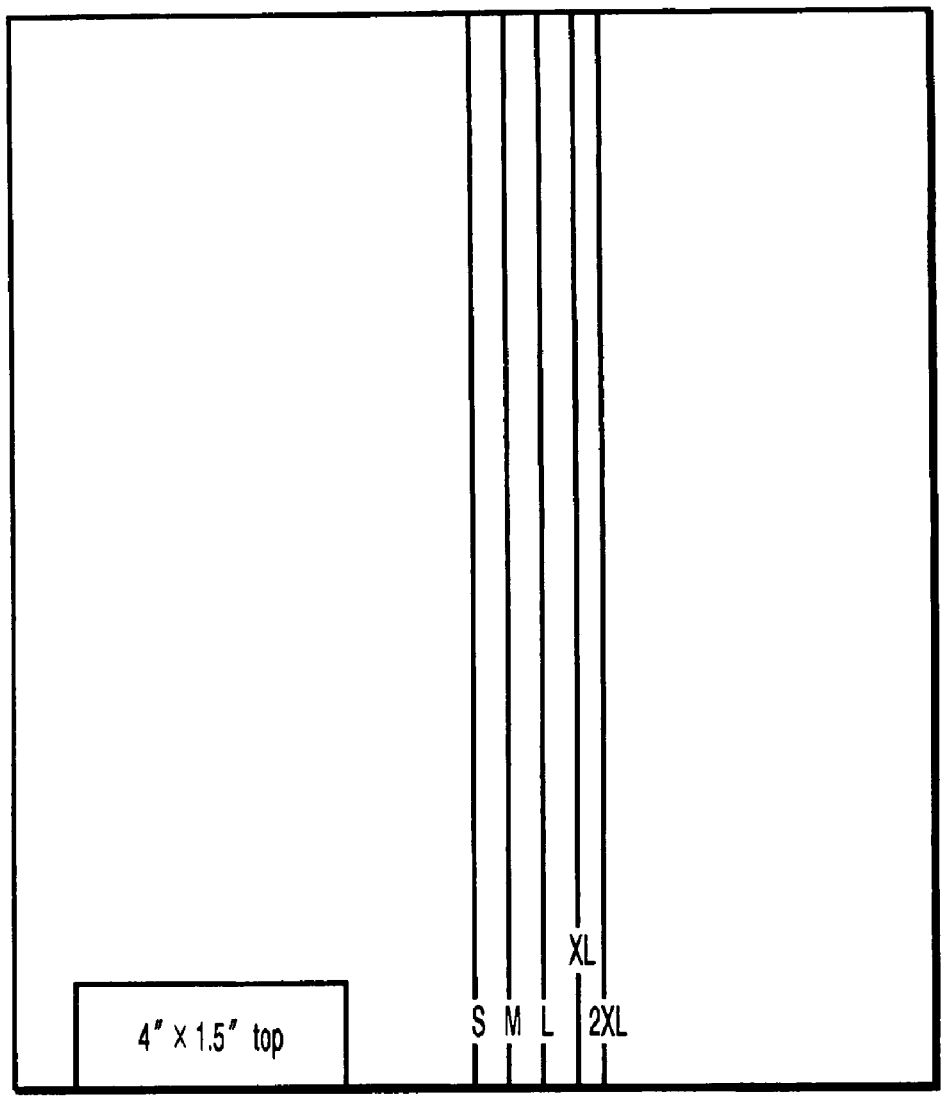
FIG. 16 is an illustrative plane view of the sheet member 50 with a second positioning index printed thereon according to the first embodiment of the invention.

Next, referring to FIGS. 15 through 17, the positioning indexes to be printed on the sheet member 50 will be described. FIG. 15 is an illustrative plane view of the sheet member 50 with a first positioning index printed thereon according the present embodiment of the invention. FIG. 16 is an illustrative plane view of the sheet member 50 with a second positioning index printed thereon according to the present embodiment of the invention. FIG. 17 is an illustrative plan view of the sheet member 50 with a third positioning index printed thereon according to the present embodiment of the invention.

First, the first positioning index, which is referred to as a "regular index" in the present embodiment, will be described. As shown in FIG. 15, the regular index is provided with a rectangle-shaped frame and a plurality of horizontal lines at 2 inches interval therebetween. The topmost horizontal line indicates 14 inches, the second line below the topmost horizontal line indicates 12 inches, and the third line below the second line indicates 10 inches. A vertical center line is provided. Further, another vertical line is provided at 3.5 inches interval from the vertical center line at each side of the vertical center line, and still another vertical line is provided at 5 inches interval from the vertical center line on each side of the vertical center line. The ink composition used for printing the regular index in the present embodiment is magenta 30%. The horizontal and vertical lines in the regular index are used generally for aligning the fabric with respect to the image to be printed based on the print data in a proper position. It should be noted that the intervals between the horizontal and vertical lines are not limited as described above, but may be adapted in arbitrary arrangement.

Next, the second positioning index, which is referred to as a "chest and pocket index" in the present embodiment, will be described. As shown in FIG. 16, the chest and pocket index is provided with a rectangular-shaped frame and a vertical center line indicating an "S" for small. Further, a second vertical line indicating an "M" for medium is provided on a right-hand side of the vertical center line at a predetermined interval from the vertical center line. Furthermore, a third vertical line, a fourth vertical line, and a fifth vertical line, which respectively indicate an "L" for large, an "XL" for extra-large, and a "2XL" for double extra-large, are provided on the right-hand side of the second vertical line at predetermined intervals from the vertical center line. At lower left of the frame, a rectangle R with an indication "4"×1.5" top" of which width is 4 inches and height is 1.5 inches is provided. The rectangle R indicates an area wherein a piece of decorative pattern is provided. The alphabet letters "S", "M", "L", "XL", and "2XL" refer to sizes of clothes such as shirts. The predetermined intervals between the vertical lines have been determined based on the sizes of the clothes in advance. A method to use the vertical lines will be described later.

Next, the third positioning index, which is referred to as a "back shoulder index" in the present embodiment, will be described. As shown in FIG. 17, the back shoulder index id provided with a rectangular-shaped frame and a vertical center line. Further, at lower center of the frame, a smaller rectangle SR with an indication "4"×1.5"" of which width is 4 inches and height is 1.5 inches is provided. Furthermore, a larger rectangle LR with an indication "7"×2.5"" of which width is 7 inches and height is 2.5 inches is provided to enclose the smaller rectangle SR. The smaller rectangle SR and the larger rectangle LR indicate areas wherein a piece of decorative pattern such as a logo and a label is printed on an upper portion of a front and a back of the shirt.

Next, referring to FIGS. 18 and 19, a method to set a T-shirt as the recording medium in position on the platen 5 having the sheet member 50 by using the second positioning index (i.e., the chest and pocket index) will be explained. FIG. 18 is an illustrative plane view of a T-shirt in size S being positioned on the platen 5 with the sheet member 50 having the second positioning index printed thereon according to the present embodiment of the invention. FIG. 19 is an illustrative plane view of a T-shirt in size XL being positioned on the platen 5 with the sheet member 50 having the second positioning index printed thereon according to the present embodiment of the invention.

Generally, sizes of T-shirts for adult include S, M, L, XL, 2XL, and the like. For example, Beefy-T (registered trademark) 5180 type T-shirt manufactured by Hanes (registered trademark) includes a size S for 18 inches×27 inches, a size M for 20 inches×29 inches, a size L for 22 inches×30 inches, a size XL for 24 inches×31 inches, and a size 2XL for 26 inches×31.5 inches. As shown in FIG. 18, when the T-shirt in size S is set in position on the platen 5 having the sheet member 50, a center line in a front body of the T-shirt is aligned to the vertical line indicating S in the chest and pocket index (i.e., the second positioning index) printed on the sheet member 50. Further, the right and left shoulder lines of the T-shirt are aligned to the lower end (the front protruded side when the platen 5 is properly installed in the fabric printer 1) of the platen 5. Thus, the T-shirt in S size is set in position on the platen 5. As previously mentioned, the rectangle R with the width 4 inches and the height 1.5 inches is an indication of the area wherein a decorative pattern is to be printed. However, it should be noted that, practically, when a size of the T-shirt to be printed is larger, it is preferable in balance in the T-shirt that the position of the decorative pattern is shifted upward in FIG. 18, which is closer to the lower hem of the body of the T-shirt. Therefore, in order to assist the user to recognize a position of a top of the decorative pattern, an indication of "top" is provided.

Next, a method to set a T-shirt in size XL as the recording medium in position on the platen 5 having the sheet member 50 by using the second positioning index (i.e., the chest and pocket index) will be explained. As shown in FIG. 19, when the T-shirt in size XL is set in position on the platen 5 having the sheet member 50, a center line in a front body of the T-shirt is aligned to the vertical line indicating XL in the chest and pocket index (i.e., the second positioning index) printed on the sheet member 50. Further, one of the right and left shoulder lines of the T-shirt (a shoulder line on the left-hand side in FIG. 19) is aligned to the lower end (the front protruded side when the platen 5 is properly installed in the fabric printer 1) of the platen 5. Thus, the T-shirt in XL size is set in position on the platen 5 with its center line aligned to the vertical line indicating XL, which is shifted in parallel from the center line of the sheet member 50. As previously mentioned, the rectangle R with the width 4 inches and the height 1.5 inches is an indication of the area wherein a decorative pattern is to be printed. Therefore, with one sheet member 50 having a plurality of vertical lines, each of which indicates a line for the T-shirt to be aligned, the same rectangle R for an approximate indication of the area to print the decorative pattern can be used for the T-shirts in different sizes including the size S and the size XL.

As has been described above, in the fabric printer 1 according to the first embodiment, the positioning index can be printed on the sheet member 50, and setting of the positioning index can be configured in the setting screen for the printer driver. Further, the plurality of lines to guide the T-shirts in various sizes are printed on the sheet member 50, therefore, the fabric can be easily placed in a correct position with respect to the platen 5 as the user aligns the fabric to the suitable line.

Next, a second embodiment of the present invention will be described. In the second embodiment, configurations of a fabric printer 2 and a personal computer 400 which are similar to the configurations of the fabric printer 1 and the personal computer 200 in the previous embodiment are referred to by identical reference numerals, and description of those will be omitted. It should be noted that the fabric printer 2 in the second embodiment is provided with a ROM 520, which includes a positioning information storing area 123 (see FIG. 4). A plurality of patterns of positioning indexes to be printed on the sheet member 50 are stored in the positioning information storing area 123, and selecting one of the positioning indexes is performed in the fabric printer 2.

Hereinafter, referring to FIGS. 20 and 21, a printing process of one of the positioning indexes performed in the fabric printer 2 according to the second embodiment will be described. FIG. 20 is a flowchart of the printing process of the positioning index performed in the fabric printer 2 according to the second embodiment of the invention. FIG. 21 illustrates a setting screen for selecting the positioning index shown on the operation panel 28 of the fabric printer 2 according to the second embodiment of the invention.

As the printing process is started, and when the menu button 184 is pressed (S41: YES), in S42, a menu screen (not shown) is displayed on the display 175, and in S43, the user is prompted to call for a screen to select one of the positioning indexes to be printed by using the up arrow button 185, the down arrow button 186, and the OK button 187. As the user specifies to select a positioning index (S43: YES), in S44, a selection screen as shown in FIG. 21 wherein the user selects one of the positioning indexes to be printed. In S43, when the other process than selecting a positioning index is specified by the user (S43: NO, S45: YES), in S46, a corresponding process is executed.

As the selection screen is displayed (S44), in S47, the user selects one of the positioning indexes to be printed by using the up arrow button 185 and the down arrow button 186. Further, in S48, when the user presses the OK button 187, the selection is entered (S48: YES). Accordingly, in S49, information corresponding to the selected positioning index is read from the positioning information storing area 123 of the ROM 520 and stored in the in-printing data storing area 132. Thereafter, in S50, when the print button 182 is pressed, in S51, the platen 5 to hold the fabric is carried to a position wherein the recording is started. In this step, the reflection on the platen 5 is detected by the photoelectric sensor 181. Further, the detected amount of reflection is stored in the sheet member detection information storing area 134 of the RAM 130.

Next, in S52, it is judged as to whether the sheet member 50 is installed on the platen 5. The judgment is made based on a detected result obtained from the photoelectric sensor 181. When the detected value stored in the sheet member detection information storing area 134 of the RAM 130 is greater than a predetermined reference value, it is determined that the sheet member 50 is installed on the platen 5 (S52: YES). Thereafter, in S53, the positioning index is printed on the sheet member 50. In S52, when the detected value is less than the predetermined reference value, it is determined that the sheet member 50 is not installed on the platen 5 (S52: NO), and in S54, a warning message such as "Set sheet on platen" is displayed on the display 175. Thereafter, the process returns to S50.

As has been described above, in the fabric printer 2 according to the second embodiment, selection of the positioning index to be printed and printing the selected positioning index on the sheet member 50 can be performed by operating the operational panel 28 of the fabric printer 2 without the personal computer 400. Therefore, the plurality of lines to guide the T-shirts in various sizes can be printed on the sheet member 50, and, the fabric can be easily placed in a correct position with respect to the platen 5 as the user aligns the fabric to the suitable line.

Although examples of carrying out the invention have been described, those skilled in the art will appreciate that there are numerous variations and permutations of the fabric printer that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the positioning index is not limited to the three patterns as described above, but can include various other patterns. For another example, the user can create a unique positioning index. Furthermore, the USB cable that connects the fabric printer and the personal computer to transport the print data can be altered with another storage medium such as a floppy (registered trademark) disk and other memory medium when the fabric printer is capable of reading such a memory medium.

Further, in the embodiments described above, the sheet member 50 is configured to be exchangeable on the platen 5, however, the sheet member 50 may be fixed onto the platen 5, and the platen may be exchanged with respect to the fabric printer according to a type of the fabric to be printed.

Furthermore, application of the present invention is not limited to an inkjet fabric printer, but the present invention can be applied to other image processing devices such as a color copier and a facsimile machine.

What is claimed is:

1. A printing apparatus for fabric, comprising:

a retainer unit having a retainer surface on which a piece of fabric is removably installed;

an ink ejecting unit which ejects ink onto a surface of the fabric retained by the retainer unit according to image data transmitted from an external device;

an image data receiving system which receives the image data transmitted from the external device; and a print controlling system which controls executing a normal printing operation wherein the image data received by the image data receiving system is printed on the surface of the piece of fabric retained by the retainer unit and a positioning information printing operation wherein positioning information to be used for arranging the piece of fabric in position with respect to the retainer surface is printed on the retainer surface.

2. The printing apparatus according to claim 1, further comprising a positioning information storing system, wherein the positioning information is stored.

3. The printing apparatus according to claim 2, wherein the positioning information stored in the positioning information storing system is used to guide the piece of fabric in position on the retainer surface, and wherein the positioning information storing system stores a plurality of patterns of positioning information, one of which is selectively used to guide the piece of fabric in position according to a type of the piece of fabric.

4. The printing apparatus according to claim 2, wherein the positioning information includes a plurality of lines each of which indicates a position of the piece of fabric to be arranged according to a size of the piece of fabric.

5. The printing apparatus according to claim 3, wherein the positioning information includes a plurality of lines each of which indicates a position of the piece of fabric to be arranged according to a size of the piece of fabric.

6. The printing apparatus according to claim 1, wherein an L* value of a color of an ink to be used for printing the positioning information in the positioning information printing operation is at most 70.

7. The printing apparatus according to claim 1, wherein the print controlling system controls printing the positioning information specified by a user via a computer being connected with the printing apparatus by ejecting the ink from an ejecting portion of the ink ejecting unit onto the retainer surface in the positioning information printing operation.

8. The printing apparatus according to claim 1, wherein the retainer unit is configured as such at least one of the retainer unit itself is exchangeable with respect to the printing apparatus and the retainer surface is exchangeable with respect to the retainer unit.

9. The printing apparatus according to claim 8, further comprising a detecting system which detects presence and absence of the retainer surface of the retainer unit.

* * * * *